US012104320B2

(12) United States Patent
Green et al.

(10) Patent No.: US 12,104,320 B2
(45) Date of Patent: Oct. 1, 2024

(54) ENZYMATIC AND ACID METHODS FOR INDIVIDUALIZING TRICHOMES

(71) Applicant: The Procter & Gamble Company, Cincinnati, OH (US)

(72) Inventors: Phillip Richard Green, Moneta, VA (US); Spencer Christopher Rupard, Morrow, OH (US); Raul Victorino Nunes, Loveland, OH (US); Nicholas William Geary, Mariemont, OH (US); Khosrow Parviz Mohammadi, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 187 days.

(21) Appl. No.: 16/452,574

(22) Filed: Jun. 26, 2019

(65) Prior Publication Data

US 2020/0002886 A1 Jan. 2, 2020

Related U.S. Application Data

(60) Provisional application No. 62/691,796, filed on Jun. 29, 2018.

(51) Int. Cl.
*D21C 5/00* (2006.01)

(52) U.S. Cl.
CPC ..... *D21C 5/005* (2013.01)

(58) Field of Classification Search
CPC ..... D21C 5/005; D21C 3/04; D21H 17/005
See application file for complete search history.

(56) References Cited

U.S. PATENT DOCUMENTS

| | | | | |
|---|---|---|---|---|
| 3,863,428 | A | 2/1975 | Baxter | |
| 3,994,771 | A | 11/1976 | Morgan, Jr. | |
| 5,772,847 | A | 6/1998 | Simpson et al. | |
| 6,576,083 | B2 * | 6/2003 | Franks | D21C 5/027 162/72 |
| 7,691,472 | B2 | 4/2010 | Vinson et al. | |
| 7,811,613 | B2 | 10/2010 | Vinson et al. | |
| 8,029,645 | B2 | 10/2011 | Mohammadi | |
| 8,056,841 | B2 | 11/2011 | Vinson et al. | |
| 8,297,543 | B2 | 10/2012 | Vinson et al. | |
| 8,425,722 | B2 | 4/2013 | Mohammadi | |
| 8,623,176 | B2 | 1/2014 | Vinson et al. | |
| 8,808,501 | B2 | 8/2014 | Vinson et al. | |
| 9,011,641 | B2 | 4/2015 | Mohammadi et al. | |
| 9,718,065 | B1 | 8/2017 | Cilia | |
| 10,227,729 | B2 | 3/2019 | Mohammadi et al. | |
| 10,309,057 | B2 | 6/2019 | Mohammadi et al. | |
| 10,344,428 | B2 | 7/2019 | Mohammadi et al. | |
| 2003/0208859 | A1 | 11/2003 | Neogi | |
| 2004/0250969 | A1 | 12/2004 | Luu | |
| 2005/0274470 | A1 | 12/2005 | Shannon | |
| 2006/0069069 | A1 * | 3/2006 | Kajander | A61K 31/19 514/89 |
| 2006/0154832 | A1 | 7/2006 | Peltier | |
| 2006/0260002 | A1 | 11/2006 | Ronen | |
| 2006/0288639 | A1 | 12/2006 | Vinson et al. | |
| 2007/0011762 | A1 | 1/2007 | Vinson et al. | |
| 2009/0054858 | A1 | 2/2009 | Cheng et al. | |
| 2009/0084513 | A1 | 4/2009 | Barnholtz et al. | |
| 2010/0239843 | A1 | 9/2010 | Luu et al. | |
| 2011/0104419 | A1 | 5/2011 | Barnholtz et al. | |
| 2011/0168342 | A1 | 7/2011 | Mohammadi | |
| 2011/0226430 | A1 | 9/2011 | Mohammadi | |
| 2013/0025808 | A1 * | 1/2013 | Vinson | D21F 11/00 162/202 |
| 2013/0220563 | A1 | 8/2013 | Mohammadi | |
| 2014/0083637 | A1 | 3/2014 | Vinson et al. | |
| 2014/0138040 | A1 | 5/2014 | Sartini et al. | |
| 2014/0141203 | A1 | 5/2014 | Sartini et al. | |
| 2015/0094252 | A1 | 4/2015 | Cuyubamba et al. | |
| 2015/0176216 | A1 | 6/2015 | Ostendorf et al. | |
| 2015/0211186 | A1 | 7/2015 | McNeil et al. | |

(Continued)

FOREIGN PATENT DOCUMENTS

| | | | |
|---|---|---|---|
| JP | H04329913 | A | 11/1992 |
| WO | WO-2004044320 | | 5/2004 |

(Continued)

OTHER PUBLICATIONS

Zhang et al. A Simple and Efficient Method for Isolating Trichomes for Downstream Analyses; Plant Cell Physiology, vol. 45, No. 2, pp. 221-224. (Year: 2004).*

Daher et al. How to Let Go: Pectin and Plant Cell Adhesion; Frontiers in Plant Science, vol. 6, Article 523, pp. 1-8. (Year: 2015).*

Da Silva Martins et al. Purification and Properties of Polygalacturonase Produced by Thermophilic Fungus Thermoascus Aurantiacus CBMAI-756 on Solid-State Fermentation; Enzyme Research, vol. 2013, Article 438645, pp. 1-7. (Year: 2013).*

Anthon et al. Pectin Methylesterase Activity and Other Factors Affecting Ph and Titratable Acidity in Processing Tomatoes; Food Chemistry, vol. 132, pp. 915-920. (Year: 2012).*

(Continued)

*Primary Examiner* — Jeanette M Lieb
*Assistant Examiner* — Paul C Martin
(74) *Attorney, Agent, or Firm* — Richard L. Alexander; Andrew J. Mueller

(57) ABSTRACT

The present invention relates to processes for individualizing trichome fibers from a trichome source, such as a leaf and/or a stem. One process comprises contacting the plant biomass with pectin hydrolyzing enzymes, thus releasing the individualized trichomes and recovering the individualized trichomes. A second process comprises contacting the plant biomass with an acidic aqueous solution, thus releasing the individualized trichomes and recovering the individualized trichomes. A third process comprises contacting the plant biomass with an acidic aqueous solution and with pectin hydrolyzing enzymes, thus releasing the individualized trichomes and recovering the individualized trichomes.

12 Claims, 12 Drawing Sheets

(56) References Cited

U.S. PATENT DOCUMENTS

| | | | |
|---|---|---|---|
| 2015/0337496 | A1 | 11/2015 | Lee |
| 2017/0175338 | A1 | 6/2017 | Mohammadi |
| 2017/0335512 | A1 | 11/2017 | Mohammadi et al. |
| 2018/0007852 | A1 | 1/2018 | Rose |
| 2020/0002887 | A1 | 1/2020 | Green et al. |
| 2020/0002889 | A1 | 1/2020 | Nunes et al. |
| 2020/0002892 | A1 | 1/2020 | Geary et al. |
| 2020/0359852 | A1 | 11/2020 | Mohammadi et al. |
| 2021/0348335 | A1 | 11/2021 | Mohammadi et al. |
| 2022/0042245 | A1 | 2/2022 | Geary et al. |

FOREIGN PATENT DOCUMENTS

| | | |
|---|---|---|
| WO | WO-2006137041 | 12/2006 |
| WO | WO-2009024897 | 2/2009 |
| WO | WO-2011053956 | 5/2011 |

OTHER PUBLICATIONS

Atanasova et al. Evolution and Functional Characterization of Pectate Lyase PEL12, a Member of a Highly Expanded Clonostachys Rosea Polysaccharide Lyase 1 Family; BMC Microbiology, vol. 18, No. 178, pp. 1-19. (Year: 2018).*

Das, B. Green Way to Recycle Paper; downloaded from: http://www.downtoearth.org.in/news/green-way-to-recycle-paper-39185, pp. 1-3. (Year: 2012).*

Dinu et al. Enzymes With New Biochemical Properties in The Pectinolytic Complex Produced by Astergillus Niger MIUG16; Journal of Biotechnology, vol. 131, No. 2, pp. 128-137. (Year: 2007).*

Castro et al. Activity and Process Stability of Purified Green Pepper (*Capsicum annuum*) Pectin Methylesterase; Journal of Agriculture and Food Chemistry, vol. 52, pp. 5724-5729. (Year: 2004).*

Niture et al. Inactivation of Polygalacturonase and Pectate Lyase Produced by Ph Tolerant Fungus Fusarium Moniliforme NCIM 1276 Om a Liquid Medium and in the Host Tissue; Microbiological Research, vol. 163, pp. 51-62. (Year: 2008).*

Sathiyaraj et al. Screening and Optimization of Pectin Lyase and Polygalacturonase Activity From Ginseng Pathogen Cylindrocarpon Destructans; Brazilian Journal of Microbiology, vol. 42, pp. 794-806. (Year: 2011 ).*

U.S. Appl. No. 16/388,986, filed Apr. 19, 2019, Khosrow Parviz Mohammadi, et al.

U.S. Appl. No. 15/378,627, filed Dec. 14, 2016, Khosrow Parviz Mohammadi, et al.

U.S. Appl. No. 16/452,659, filed Jun. 26, 2019, Phillip Richard Green, et al.

U.S. Appl. No. 16/452,579, filed Jun. 26, 2019, Phillip Richard Green, et al.

U.S. Appl. No. 16/452,582, filed Jun. 26, 2019, Nicholas William Geary, et al.

PCT International Search Report dated Feb. 10, 2017—4 pages.

PCT International Search Report (Case 14167) dated Jul. 20, 2017—6 pages.

PCT International Search Report (Case 14354) dated Jul. 20, 2017—5 pages.

PCT International Search Report dated Jul. 20, 2017—6 pages.

PCT International Search Report dated Jul. 20, 2017—5 pages.

All Office Actions U.S. Appl. No. 14/963,278.

All Office Actions U.S. Appl. No. 15,378,430.

All Office Actions U.S. Appl. No. 16/388,986.

All Office Actions U.S. Appl. No. 15/378,627.

All Office Actions U.S. Appl. No. 15/602,187.

All Office Actions U.S. Appl. No. 16/452,659.

All Office Actions U.S. Appl. No. 16/452,579.

All Office Actions U.S. Appl. No. 16/452,582.

Documentation for ImageJ software, National Institute of Health, 3 pages, 2007, online], retrieved from the Internet, [retrieved Jan. 8, 2017], URL:https://imagej.nih.gov/ij/index.html.

James Mauseth, Botany, Oct. 25, 2019, Jones and Bartlett Learning, p. 76 (Year: 2019).

Zhang, et al., "A Simple and Efficient Method for Isolating Trichomes for Downstream Analyses", Plant and Cell Phys., vol. 45, No. 2, pp. 221-224. (Year: 2004).

All Office Actions; U.S. Appl. No. 17/382,725, filed Jul. 22, 2021.

All Office Actions; U.S. Appl. No. 17/510,434, filed Oct. 26, 2021.

All Office Actions; U.S. Appl. No. 17/868,234, filed Jul. 19, 2022.

Unpublished U.S. Appl. No. 17/868,234, filed Sep. 19, 2022, to Phillip Richard Green et al.

Unpublished U.S. Appl. No. 17/895,570, filed Aug. 25, 2022 to Raul Victorino Nunes et al.

Bourland et al., "Breeding and Genetics", The Journal of Cotton Science, 21, pp. 296-305. (Year: 2017).

Non-Final Office Action; U.S. Appl. No. 17/895,570 dated Aug. 25, 2022.

Notice of Allowance; U.S. Appl. No. 17/895,570 dated Sep. 27, 2023.

All Office Actions; U.S. Appl. No. 18/495,794, filed Oct. 27, 2023.

All Office Actions; U.S. Appl. No. 18/539,367, filed Dec. 14, 2023.

Unpublished U.S. Appl. No. 18/495,794, filed Oct. 27, 2023 to Phillip Richard Green et al.

Unpublished U.S. Appl. No. 18/539,367, filed Dec. 14, 2023 to Raul Victorino Nunes et al.

* cited by examiner

Acid Treated Acid plus Enzyme Treated

Acid Treated Acid plus Enzyme Treated

12 Mesh Retain 120 Mesh Retain

ENZYMATIC AND ACID METHODS FOR INDIVIDUALIZING TRICHOMES

CROSS-REFERENCE TO RELATED APPLICATION

This application claims the benefit of U.S. Provisional Application No. 62/691,796, filed Jun. 29, 2018, the substance of which is incorporated herein by reference.

TECHNICAL FIELD OF THE INVENTION

The present invention relates to processes for individualizing trichome fibers from a trichome source, such as a leaf and/or a stem, and more particularly to processes for individualizing (separating) trichome fibers from *Stachys byzantina* plants.

BACKGROUND OF THE INVENTION

Due to the continued interest in sustainability, use of non-wood materials, such as trichomes and bamboo fibers, to make fibrous structures (e.g. sanitary tissue products) has recently increased. One non-wood material that shows promise as a replacement or partial replacement of wood pulp fibers in fibrous structures, such as sanitary tissue products, is trichomes. More specifically, individualized trichome fibers obtained from plants, such as *Stachys byzantina* plants (e.g. Lamb's Ear plants) are of interest. However, "clean" individualized trichome fibers are challenging to obtain in large amounts due to impurities such as stems, specks, dirt, clay, sand, and other non-trichome materials that are present with the individualized trichome fibers. These impurities are the result of the processes used for harvesting and extracting the individualized trichome fibers from the plants. The impurities find their way into fibrous structures made with the individualized trichome fibers and result in the fibrous structures looking dirty and filled with specks that render the fibrous structures unacceptable to consumers of the fibrous structure products.

Known processes for individualizing (separating) trichome fibers from plants typically use mechanical cutting and air sorting operations. Such operations are very costly, require high amounts of maintenance, are normally batch processes rather than continuous processes, and the individualized trichome fibers still contain a level of non-trichome materials, for example specks, sand, stems, that is not acceptable to consumers.

Some processes for isolating trichome fibers from trichome sources are known in the art. For example, benchtop scale chemical separation processes for removing trichomes, for example *Arabidopsis* trichomes from the Brassicaceae family, from trichome sources are known. Such a known benchtop scale chemical separation process utilizes a mixture of a chelating agent, such as ethylene glycol bis-(B-aminoethyl ether)-N,N,N',N'-tetraacetic acid ("EGTA") and a nonionic surfactant, such as Triton X-100. The process incubates the trichome source in a mixture of EGTA and Triton X-100 at 4° C. for 16-24 hours and/or at 50° C. for 1 hour followed by gentle rubbing using an artist's paintbrush. Such a process is not feasible for a large scale commercial process. A mechanical process for isolating (individualizing) trichome fibers from trichome sources to obtain individualized trichome fibers is known and can be practiced on a commercial scale. However, such mechanical processes result in the individualized trichome fibers containing undesirable contaminants, such as dirt, fines, and non-trichome materials such as parts of leaves and/or stems. This process also requires dried plant material dependent upon at least three rain free days after harvesting, or expensive heat drying and storage. In addition, a chemical process is known which requires reacting the trichome source plant material with 1%-10% chelating agent and 0.01%-5.0% surfactant at high temperature and pressure at an alkaline pH, followed by shear mixing. These conditions require more expensive equipment, chemicals and use large amounts of energy.

Accordingly, there is a need for a process that is able to individualize trichome fibers from trichome sources (for example plants) in a cost effective, low maintenance, continuous process that results in the individualized trichome fibers having either no or a consumer acceptable level of non-trichome materials (impurities present in the plants and/or growing environments from which the plants are harvested) such that the individualized trichome fibers can be used to make consumer desirable fibrous structures, such as sanitary tissue products.

SUMMARY OF THE INVENTION

The present invention fulfills the need described above by providing a commercially viable process for individualizing trichome fibers from a trichome source. This is achieved using simple stirred tank reactors at lower temperatures and ambient pressure with minimal amounts of chemicals and without the use of chelators.

In one embodiment of the present invention, plant biomass is suspended with stirring in an aqueous solution, the solution is adjusted to an optimal pH and temperature, pectinases are added and allowed to react until the trichomes are released from the plant biomass. The trichomes are recovered from the suspension.

In another embodiment, plant biomass is suspended with stirring in an aqueous solution, the solution is adjusted to an optimal acidic pH and temperature and allowed to react until the trichomes are released from the plant biomass. The trichomes are recovered from the suspension.

In another embodiment, plant biomass is first suspended with stirring in an aqueous solution, the solution is adjusted to an optimal acidic pH and temperature, and allowed to react until trichomes are released from the plant biomass. The pH is then adjusted to an optimal level for pectinase activity, and reacted to further remove non-trichome plant biomass. The trichomes are recovered from the suspension.

In yet another example of the present invention, a fibrous structure, for example a single- or multi-ply sanitary tissue product, such as a toilet tissue, paper towels, facial tissue, wipes, comprising individualized trichomes from the process of the present invention is provided.

The present invention provides a novel process for individualizing trichome fibers from a trichome source, wherein the process overcomes the negatives associated with known process for removing trichome fibers from trichome sources and fibrous structure comprising such individualized trichomes.

DETAILED DESCRIPTION OF THE INVENTION

Definitions

Figure 1:
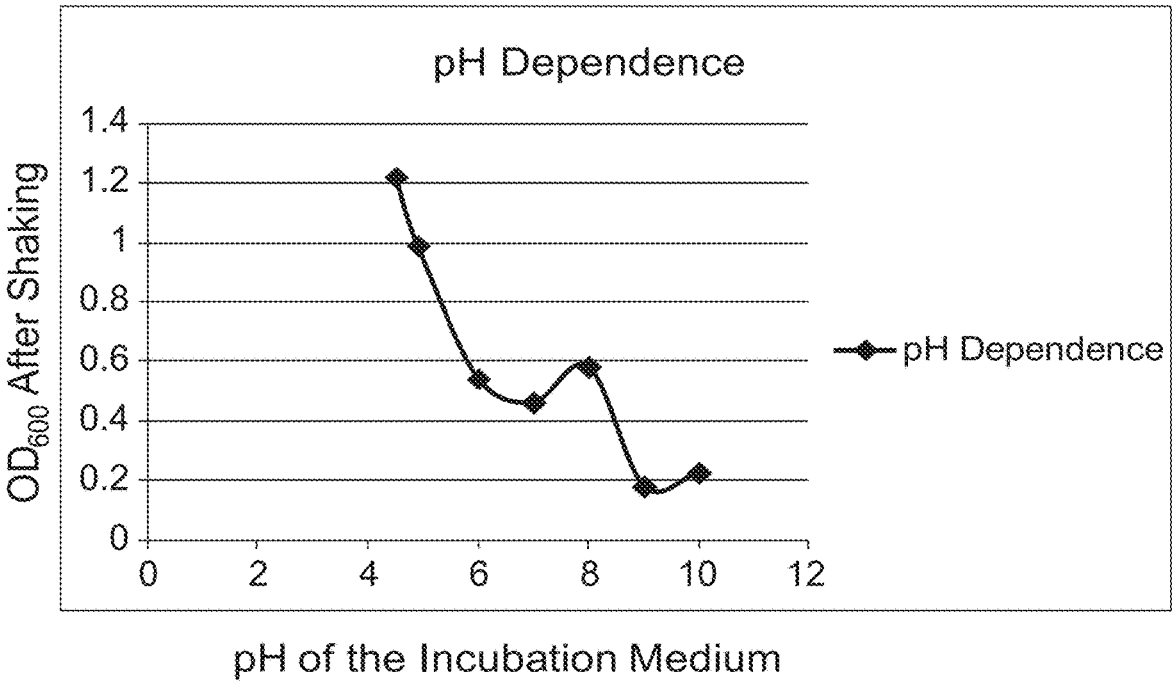
FIG. 1 is a chart demonstrating Pectinase catalyzed release of trichomes from cut, dry biomass vs. pH of the reaction medium.

"Biomass" as used herein is plant derived material which includes leaves, stems and bracts that exhibit attached trichomes. The plant derived material may be freshly cut or freshly cut and frozen, or refrigerated and contain at least 50% water, or at least 60% water, or at least 70% water, or at least 80% water, or at least 90% water by weight. The plant derived material may be dried and contain less than 50% water, or less than 40% water, or less than 30% water, or less than 20% water, or less than 10% water by weight. The biomass may also contain less than 5% by weight of non-trichome containing plant material from non-target plants that are harvested along with the trichome containing plant material.

"Biomass-Enzyme Suspension" as used herein is a mixture of the aqueous solution into which the Pectinase enzymes have been diluted, and into which the biomass has been added to form a 2-phase solution plus biomass system.

"Bract" as used herein is a modified or specialized leaf, especially one associated with a reproductive structure such as a flower, inflorescence axis, or cone scale.

"Consumer Product" as used herein is typically a disposable product used for a variety of personal and household care applications. These include, but are not limited to sanitary tissues, paper towels, catamenials, diapers, wipes, personal cleansing and hygiene such as shampoo, antiperspirants, deodorants and hair removal, and household products such as laundry detergents, dishwashing detergents and deodorizers.

"Contacting" as used herein means any situation wherein one component has access to another component. Thus, when biomass is contacted with an enzyme, the enzyme has access to the biomass such that it catalyzes a reaction with the biomass. This could occur in a suspension of biomass in an aqueous milieu, but could also occur if a solution containing dissolved enzyme is sprayed onto the biomass, or if dry enzyme is added to the biomass.

"Enzymes" as used herein are proteinaceous molecules capable of catalyzing a chemical reaction. An enzyme may be naturally occurring and utilized as is, or it can be artificially modified in its amino acid sequence or through chemical reactions to improve the catalytic performance for the specific application. An enzyme as used herein may also be comprised of more than one identifiable protein sequence, i.e., a mixture containing more than one enzyme.

"Fiber" as used herein means an elongate physical structure having an apparent length greatly exceeding its apparent diameter, i.e. a length to diameter ratio of at least about 10. Fibers having a non-circular cross-section and/or tubular shape are common; the "diameter" in this case may be considered to be the diameter of a circle having cross-sectional area equal to the cross-sectional area of the fiber. More specifically, as used herein, "fiber" refers to fibrous structure-making fibers. The present invention contemplates the use of a variety of fibrous structure-making fibers, such as, for example, natural fibers, such as trichome fibers and/or wood pulp fibers, or synthetic fibers, or any other suitable fibers, and any combination thereof.

"Fiber Length", "Average Fiber Length" and "Weighted Average Fiber Length", are terms used interchangeably herein all intended to represent the "Length Weighted Average Fiber Length" as determined for example by means of a Valmet Fiber Image Analyzer-Valmet FS5 commercially available from Valmet, Espoo, Finland. The instructions in the Owner's Manual K12690 V1.2 EN supplied with the unit detail the formula used to arrive at this average. The recommended method for measuring fiber length using this instrument is essentially the same as detailed by the manufacturer in its owner's manual. The recommended consistencies for charging to the FiberLab are somewhat lower than recommended by the manufacturer since this gives more reliable operation. Short fiber furnishes, as defined herein, should be diluted to 0.02-0.04% prior to charging to the instrument. Long fiber furnishes, as defined herein, should be diluted to 0.15%-0.30%. Alternatively, fiber length may be determined by sending the short fibers to a contract lab, such as Integrated Paper Services, Appleton, Wisconsin.

Fibrous structures may be comprised of a combination of long fibers and short fibers. Non-limiting examples of suitable long fibers for use in the present invention include fibers that exhibit an average fiber length of less than about 7 mm and/or less than about 5 mm and/or less than about 3 mm and/or less than about 2.5 mm and/or from about 1 mm to about 5 mm and/or from about 1.5 mm to about 3 mm and/or from about 1.8 mm to about 4 mm and/or from about 2 mm to about 3 mm.

Non-limiting examples of suitable short fibers suitable for use in the present invention include fibers that exhibit an average fiber length of less than about 5 mm and/or less than about 3 mm and/or less than about 1.2 mm and/or less than about 1.0 mm and/or from about 0.4 mm to about 5 mm and/or from about 0.5 mm to about 3 mm and/or from about 0.5 mm to about 1.2 mm and/5 or from about 0.6 mm to about 1.0 mm.

The individualized trichomes used in the present invention may include trichome fibers. The trichome fibers may be characterized as either long fibers or short fibers.

"Harvest" or "harvesting" as used herein means a process of gathering mature plants, for example by cutting and then collecting the plants, from a field, which may optionally include moving the plants to a processing operation or storage area.

"Leaves" as used herein are organs of a vascular plant and are the principal lateral appendages of the stem.

"Pectin" as used herein is a structural heteropolysaccharide contained in the primary cell walls of terrestrial plants. Pectin consists of a complex set of polysaccharides that are present in most primary cell walls and are particularly abundant in the non-woody parts of terrestrial plants. Pectin is a major component of the middle lamella, where it helps to bind cells together, but is also found in primary cell walls.

"Pectinase" as used herein is any enzyme or mixture of enzymes that catalyze hydrolytic reactions on various forms of pectin. Commercial Pectinase products often contain multiple types of pectin active enzymes such as polygalacturonase (EC 3.2.1.15), Pectin Lyase (EC 4.2.2.10), Pectate Lyase (EC 4.2.2.2), Pectin Methyl Esterase (EC 3.1.1.11), polymethyl galacturonase, (EC 3.2.1.-) and polygalacturonate lyase, (EC 4.2.2.9).

"Pulping" as used herein refers to the wet chemical processes applied used to liberate cellulosic fibers from biomass, typically wood, fiber crops and paper. One type of wet chemical pulping is the Kraft Process which utilizes sodium sulfite, alkali and 170-176° C. water in the reaction. Another type of wet chemical pulping is the Soda Process which utilizes limewater, soda crystals and 178.9° C. water in the reaction. Another type of wet chemical pulping is the sulfite process which utilizes salts of sulfurous acid at pH 1.5-5 and water at 130-160° C. in the reaction.

"Sifting" as used herein means a process that separates and retains coarse parts with a sieve and/or screen allowing less coarse parts to pass through the sieve and/or screen.

"Stem" as used herein means a plant's axis that bears buds and shoots with leaves and, at its basal end, roots. In one example, the stem is the stalk of a plant.

"Trichome" or "trichome fiber" as used herein means an epidermal attachment of a varying shape, structure and/or function of a non-seed portion of a plant. In one example, a trichome is an outgrowth of the epidermis of a non-seed portion of a plant. The outgrowth may extend from an epidermal cell. In one embodiment, the outgrowth is a trichome fiber. The outgrowth may be a hairlike or bristle-like outgrowth from the epidermis of a plant. Trichomes may protect the plant tissues present on a plant. Trichomes may for example protect leaves and stems from attack by other organisms, particularly insects or other foraging animals and/or they may regulate light and/or temperature and/or moisture. They may also produce glands in the forms of scales, different papills and, in roots, often they may function to absorb water and/or moisture. A trichome may be formed by one cell or many cells. The term "individualized trichome" as used herein means trichomes which have been artificially separated by a suitable method for individualizing trichomes from their host plant. In other words, individualized trichomes as used herein means that the trichomes become separated from a non-seed portion of a host plant by some non-naturally occurring action. In one example, individualized trichomes are artificially separated in a location that is sheltered from nature. Primarily, individualized trichomes will be fragments or entire trichomes with essentially no remnant of the host plant attached. However, individualized trichomes can also comprise a minor fraction of trichomes retaining a portion of the host plant still attached, as well as a minor fraction of trichomes in the form of a plurality of trichomes bound by their individual attachment to a common remnant of the host plant. Individualized trichomes may comprise a portion of a pulp or mass further comprising other materials. Other materials include nontrichome-bearing fragments of the host plant. In one example of the present invention, the individualized trichomes may be classified to enrich the individualized trichomal content at the expense of mass not constituting individualized trichomes. Individualized trichomes may be converted into chemical derivatives including but not limited to cellulose derivatives, for example, regenerated cellulose such as rayon; cellulose ethers such as methyl cellulose, carboxymethyl cellulose, and hydroxyethyl cellulose; cellulose esters such as cellulose acetate and cellulose butyrate; and nitrocellulose. Individualized trichomes may also be used in their physical form, usually fibrous, and herein referred to "trichome fibers", as a component of fibrous structures.

Trichome fibers are different from seed hair fibers in that they are not attached to seed portions of a plant. For example, trichome fibers, unlike seed hair fibers, are not attached to a seed or a seed pod epidermis. Cotton, kapok, milkweed, and coconut coir are nonlimiting examples of seed hair fibers. Further, trichome fibers are different from nonwood bast and/or core fibers in that they are not attached to the bast, also known as phloem, or the core, also known as xylem portions of a nonwood dicotyledonous plant stem. Nonlimiting examples of plants which have been used to yield nonwood bast fibers and/or nonwood core fibers include kenaf, jute, flax, ramie and hemp. Further trichome fibers are different from monocotyledonous plant derived fibers such as those derived from cereal straws (wheat, rye, barley, oat, etc), stalks (corn, cotton, sorghum, Hesperaloe funifera, etc.), canes (bamboo, bagasse, etc.), grasses (esparto, lemon, sabai, switchgrass, etc), since such monocotyledonous plant derived fibers are not attached to an epidermis of a plant. Further, trichome fibers are different from leaf fibers in that they do not originate from within the leaf structure. Sisal and abaca are sometimes liberated as leaf fibers. Finally, trichome fibers are different from wood pulp fibers since wood pulp fibers are not outgrowths from the epidermis of a plant; namely, a tree. Wood pulp fibers rather originate from the secondary xylem portion of the tree stem.

In one example, the trichome fibers of the present invention are individualized from plants in the following families: Labiatae (Lamiaceae), Asteraceae, Scrophulariaceae, Greyiaceae, Fabaceae, Solanaceae, Convolvulaceae, Malvaceae, Loganiaceae, Rutaceae, Rhamnaceae, Geraniaceae, Melastomataceae, Bromeliaceae, Hypericaceae, Polygonaceae, Euphorbiaceae, Crassulaceae, Poaceae, Verbenaceae, and mixtures thereof.

In another example, the trichome fibers of the present invention are individualized from plants in the Labiatae (Lamiaceae) family, for example from one or more *Stachys byzantine* plants, more particularly, the *Stachys lanata* (commonly referred to as lamb's ear) plant.

Sources of Trichomes

A variety of plants may be used as the source of trichomes. Essentially all plants have trichomes. Those skilled in the art will recognize that some plants will have trichomes of sufficient mass fraction and/or the overall growth rate and/or robustness of the plant so that they may offer attractive agricultural economy to make them more suitable for a large commercial process, such as using them as a source of chemicals, e.g. cellulose, or assembling them into fibrous structures, such as disposable fibrous structures.

Trichomes may have a wide range of morphology and chemical properties. For example, the trichomes may be in the form of fibers; namely, trichome fibers. Such trichome fibers may have a high length to diameter ratio.

The following sources are offered as non-limiting examples of trichome-bearing plants (suitable sources) for obtaining trichomes, especially trichome fibers. Non-limiting examples of suitable sources for obtaining trichomes, especially trichome fibers, are plants in the Labiatae (Lamiaceae) family commonly referred to as the mint family. Examples of suitable species in the Labiatae family include *Stachys byzantina*, also known as *Stachys lanata* commonly referred to as lamb's ear, woolly betony, or woundwort. The term *Stachys byzantina* as used herein also includes cultivars *Stachys byzantina* 'Primrose Heron', *Stachys byzantina* 'Helene von Stein' (sometimes referred to as *Stachys byzantina* 'Big Ears'), *Stachys byzantina* 'Cotton Boll', *Stachys byzantina* 'Variegated' (sometimes referred to as *Stachys byzantina* 'Striped Phantom'), and *Stachys byzantina* 'Silver Carpet'.

Additional examples of suitable species in the Labiatae family include the *arcticus* 30 subspecies of *Thymus praecox*, commonly referred to as creeping thyme and the pseudolanuginosus subspecies of *Thymus praecox*, commonly referred to as wooly thyme. Further examples of suitable species in the Labiatae family include several species in the genus *Salvia* (sage), including *Salvia leucantha*, commonly referred to as the Mexican bush sage; *Salvia tarahumara*, commonly referred to as the grape scented Indian sage; *Salvia apiana*, commonly referred to as white sage; *Salvia funereal*, commonly referred to as Death Valley sage; *Salvia sagittata*, commonly referred to as balsamic sage; and *Salvia argentiae*, commonly referred to as silver sage.

Even further examples of suitable 5 species in the Labiatae family include *Lavandula lanata*, commonly referred to as wooly lavender; *Marrubium vulgare*, commonly referred to as horehound; Plectranthus *argentatus*, commonly referred to as silver shield; and Plectranthus *tomentosa*.

Non-limiting examples of other suitable sources for obtaining trichomes, especially trichome fibers are plants in the Asteraceae family commonly referred to as the sunflower family. Examples of suitable species in the Asteraceae family include *Artemisia stelleriana*, also known as silver brocade; *Haplopappus macronema*, also known as the whitestem goldenbush; *Helichrysum petiolare; Centaurea maritime*, also known as *Centaurea gymnocarpa* or dusty miller; *Achillea tomentosum*, also known as wooly yarrow; *Anaphalis margaritacea*, also known as pearly everlasting; and *Encelia farinose*, also known as brittle bush. Additional examples of suitable species in the Asteraceae family include *Senecio brachyglottis* and *Senecio haworthii*, the latter also known as *Kleinia haworthii.*

Non-limiting examples of other suitable sources for obtaining trichomes, especially trichome fibers, are plants in the Scrophulariaceae family commonly referred to as the figwort or snapdragon family. An example of a suitable species in the Scrophulariaceae family includes *Pedicularis kanei*, also known as the wooly lousewort. Additional examples of suitable species in the Scrophulariaceae family include the mullein species (*Verbascum*) such as *Verbascum* hybridium, also known as snow maiden; *Verbascum thapsus*, also known as common mullein; *Verbascum baldaccii; Verbascum bombyciferum; Verbascum broussa; Verbascum chaixii; Verbascum dumulsum; Verbascum laciniatum; Verbascum lanatum; Verbascum longifolium; Verbascum lychnitis; Verbascum olympicum; Verbascum paniculatum; Verbascum phlomoides; Verbascum phoeniceum; Verbascum speciosum; Verbascum thapsiforme; Verbascum virgatum; Verbascum wiedemannianum*; and various mullein hybrids including *Verbascum* 'Helen Johnson' and *Verbascum* 'Jackie'. Further examples of suitable species in the Scrophulariaceae family include *Stemodia tomentosa* and *Stemodia durantifolia.*

Non-limiting examples of other suitable sources for obtaining trichomes, especially trichome fibers include *Greyia radlkoferi* and *Greyia flanmaganii* plants in the Greyiaceae family commonly referred to as the wild bottlebrush family. Non-limiting examples of other suitable sources for obtaining trichomes, especially trichome fibers include members of the Fabaceae (legume) family. These include the *Glycine max*, commonly referred to as the soybean, and *Trifolium pratense* L, commonly referred to as medium and/or mammoth red clover.

Non-limiting examples of other suitable sources for obtaining trichomes, especially trichome fibers include members of the Solanaceae family including varieties of *Lycopersicum esculentum*, otherwise known as the common tomato. Non-limiting examples of other suitable sources for obtaining trichomes, especially trichome fibers include members of the Convolvulaceae (morning glory) family, including *Argyreia nervosa*, commonly referred to as the wooly morning glory and *Convolvulus cneorum*, commonly referred to as the bush morning glory.

Non-limiting examples of other suitable sources for obtaining trichomes, especially trichome fibers include members of the Malvaceae (mallow) family, including *Anoda cristata*, commonly referred to as spurred *anoda* and *Abutilon theophrasti*, commonly referred to as velvetleaf.

Non-limiting examples of other suitable sources for obtaining trichomes, especially trichome fibers include *Buddleia marrubiifolia*, commonly referred to as the wooly butterfly bush of the Loganiaceae family; the *Casimiroa tetrameria*, commonly referred to as the wooly leafed sapote of the Rutaceae family; the *Ceanothus tomentosus*, commonly referred to as the wooly leafed mountain liliac of the Rhamnaceae family; the 'Philippe Vapelle' cultivar of renardii in the Geraniaceae (geranium) family; the *Tibouchina urvilleana*, commonly referred to as the Brazilian spider flower of the Melastomataceae family; the *Tillandsia recurvata*, commonly referred to as ballmoss of the Bromeliaceae (pineapple) family; the *Hypericum tomentosum*, commonly referred to as the wooly St. John's wort of the Hypericaceae family; the 30 *Chorizanthe orcuttiana*, commonly referred to as the San Diego spineflower of the Polygonaceae family; Eremocarpus setigerus, commonly referred to as the doveweed of the Euphorbiaceae or spurge family; *Kalanchoe tomentosa*, commonly referred to as the panda plant of the Crassulaceae family; and *Cynodon dactylon*, commonly referred to as Bermuda grass, of the Poaceae family; and *Congea tomentosa*, commonly referred to as the shower orchid, of the Verbenaceae family.

Suitable trichome-bearing plants are commercially available from nurseries and other plant-selling commercial venues. For example, *Stachys byzantina* may be purchased and/or viewed at Blanchette Gardens, Carlisle, MA.

Trichome Release Processes

In one embodiment of the present invention, the plant biomass is suspended in solution, the one or more enzymes are added, and the suspension is mixed until the trichomes are released from the stems or the leaves are disrupted thereby releasing the trichomes. The biomass from the trichome source plant is processed by:

a. Suspending the plant biomass in an aqueous mixture at a defined temperature and pH,
b. Contacting the plant biomass with one or more enzymes wherein the enzymes effect the release of the trichomes from the biomass, and
c. Removing individualized trichomes from the mixture.

The aqueous mixture may be comprised of from about 0.5% to about 99% water, or from about 0.5% to about 95% water, or from about 0.5% to about 90% water, or from about 0.5% to about 80% water, or from about 0.5% to about 60% water, or from about 0.5% to about 40% water, or from about 0.5% to about 20% water, or greater than 10% water, or greater than 1% water. The temperature can be kept constant or be varied during the reaction.

To an extent, higher temperatures increase the rate of the reactions, but too high a temperature can inactivate the enzymes, so an upper limit should be determined depending upon the particular enzymes. In one embodiment, the minimum temperature is 10° C., in another embodiment, the minimum temperature is 20°. In one embodiment, the minimum temperature is 30° C. In another embodiment, the minimum temperature is 35° C. In one embodiment, the minimum temperature is 40° C. In another embodiment, the minimum temperature is 45° C. Some enzymes may be found in nature or engineered to be active at higher temperatures, in which case, in one embodiment, the minimum temperature is 50° C., and in another embodiment, the minimum temperature is 60° C. In another embodiment, the maximum temperature is that in which the enzymes remain active for the duration of the reaction.

The pH can be kept constant or be varied during the reaction. Enzymes typically exhibit maximum activity at a specific pH or pH range. Outside of this range, the rate of the reaction will decline. Too low (acidic) or too high (alkaline) pH can inactivate the enzymes, so the range must be determined depending upon the particular enzymes. Furthermore, the overall rate of the reaction may be dependent upon more than the enzymatic activity, in which case the overall rate of the reaction may be optimized at a pH distinct from what is considered the maximum for the enzyme activity. For the reaction described herein, in one embodiment the pH is less than 6.0, in another embodiment the pH is less than 5.5. In one embodiment, the pH is less than 5.0, and in another embodiment the pH less than 4.5. In one embodiment, the pH is less than 4.0, and in another embodiment the pH less than 3.5. In another embodiment, the pH is less than or equal to 2.5. The pH may be adjusted by various methods and include, although not limited by, a buffering salt such as sodium citrate. A pH stat may also be used to control the addition of acid such as, but not limited to hydrochloric acid, or base such as, but not limited to sodium hydroxide.

The reaction is allowed to proceed until trichomes are released from the biomass, such as from stems, and the trichomes released from the biomass in which the non-trichome biomass is degraded. Upon completion of the reaction, the aqueous suspension contains released trichomes, along with trichome free stems and other biomass that is not completely degraded.

The trichomes are then removed and recovered from the suspension in such a way that the remaining non-trichome biomass is separated from the trichomes and the trichomes are separated from the liquid.

In another embodiment of the present invention, the plant biomass is suspended in solution, the pH is adjusted, and the suspension is mixed until the trichomes are released from the stems or the leaves are disrupted thereby releasing the trichomes. The biomass from the trichome source plant is processed by a. Obtaining plant biomass comprising trichomes,
b. Contacting the plant biomass with an acidic solution at a temperature and pH less than 5.0, wherein the acid effects the release of the trichomes from the biomass, and
c. Removing individualized trichomes from the biomass.

The aqueous mixture may be comprised of greater than 99% water, or greater than 95% water, or greater than 90% water, or greater than 80% water, or greater than 60% water, or greater than 40% water, or greater than 20% water, or greater than 10% water, or greater than 1% water. The temperature can be kept constant or be varied during the reaction.

Higher temperatures increase the rate of the acid reaction, but too high a temperature can hydrolyze the trichome cellulose, so an upper limit must be determined. In one embodiment, the temperature is greater than 10° C., and in another embodiment, the temperature is greater than 20° C. In one embodiment, the temperature is greater than 30° C., and in another embodiment, the temperature is greater than 40° C. In one embodiment, the temperature is greater than 50° C., and in another embodiment, the temperature is greater than 60° C. In one embodiment, the temperature is greater than 70° C., and in another embodiment, the temperature is greater than 80° C.

The pH can be kept constant or can be varied during the reaction. For the reaction described herein, in one embodiment, the pH is less than 5.0, and in another embodiment, the pH is less than 4.0. In one embodiment, the pH is less than 3.0, and in another embodiment, the pH is less than 2.5. In another embodiment, the pH is equal to or less than 2.0. The pH may be controlled by various methods and include, although not limited by, a buffering salt such as sodium citrate. A pH stat may also be used to control the addition of acid such as, but not limited to hydrochloric acid, or base such as, but not limited to sodium hydroxide.

The reaction is allowed to proceed until trichomes are released from the biomass, such as from stems, and the trichomes released from the biomass in which the non-trichome biomass is degraded. Upon completion of the reaction, the aqueous suspension contains released trichomes, along with trichome free stems and other biomass that is not completely degraded.

This invention is different from the pulping processes. The Kraft and Soda processes are performed at higher temperatures and at alkaline pH. While the sulfite process also utilizes a pH from 1.5-5.0, it only utilizes sulfurous acid salts and at temperatures of 130-160° C., which are much higher that what is taught in this disclosure.

The trichomes are then removed and recovered from the suspension in such a way that the remaining non-trichome biomass is separated from the trichomes and the trichomes are separated from the liquid.

In another embodiment of the present invention, the plant biomass is suspended in solution, the pH is adjusted, and the suspension is mixed until the trichomes are released from the stems or the leaves are disrupted thereby releasing the trichomes. The biomass from the trichome source plant is processed by a. Obtaining plant biomass comprising trichomes,
b. Contacting the plant biomass with an acidic solution of pH less than 5.0 and at a temperature wherein the acid effects the release of the trichomes from the biomass,
c. Adjusting the pH and the temperature,
d. One or more enzymes are added and allowed to react, and
e. The individualized trichomes are removed from the suspension.

In one embodiment, the aqueous mixture is comprised of up to 99% water. In another embodiment, the aqueous mixture is comprised of up to 95% water. In another embodiment, the aqueous mixture is comprised of up to 90% water.

In one embodiment, the aqueous mixture is comprised of at least 80% water. In one embodiment, the aqueous mixture is comprised of at least 60% water. In one embodiment, the aqueous mixture is comprised of at least 40% water. In one embodiment, the aqueous mixture is comprised of at least 20% water. In one embodiment, the aqueous mixture is comprised of at least 10% water. In one embodiment, the aqueous mixture is comprised of at least 1% water. The temperature can be kept constant or be varied during the reaction.

Higher temperatures increase the rate of the acid reaction, but too high a temperature can hydrolyze the trichome cellulose, so an upper limit must be determined. In one embodiment, the temperature is greater than 10° C., and in another embodiment, the temperature is greater than 20° C. In one embodiment, the temperature is greater than 30° C., and in another embodiment, the temperature is greater than 40° C. In one embodiment, the temperature is greater than 50° C., and in another embodiment, the temperature is greater than 60° C. In one embodiment, the temperature is greater than 70° C., and in another embodiment, the temperature is greater than 80° C.

The pH can be kept constant or can be varied during the reaction. For the reaction described herein, in one embodiment, the pH is less than 4.0, and in another embodiment, the pH is less than 3.5. In one embodiment, the pH is less than 3.0, and in another embodiment, the pH is less than 2.5. In another embodiment, the pH is equal to or less than 2.0. The pH may be controlled by various methods and include, although not limited by, a buffering salt such as sodium citrate. A pH stat may also be used to control the addition of acid such as, but not limited to hydrochloric acid, or base such as, but not limited to sodium hydroxide.

The reaction is allowed to proceed until trichomes are released from the biomass, such as from stems, and the trichomes released from the biomass in which the non-trichome biomass is degraded. Upon completion of the reaction, the aqueous suspension contains released trichomes, along with trichome free stems and other biomass that is not completely degraded.

Enzymatic Addition

The pH and temperature may be adjusted to conditions optimal for enzymatic activity. One or more enzymes are added, and the suspension is mixed until the much of the remaining leaves are disrupted.

To an extent, higher temperatures increase the rate of the reactions, but too high a temperature can inactivate the enzymes, so an upper limit must be determined depending upon the particular enzymes. In one embodiment, the temperature is greater than 10° C., and in another embodiment, the temperature is greater than 20° C. In one embodiment, the temperature is greater than 30° C., and in another embodiment, the temperature is greater than 35° C. In one embodiment, the temperature is greater than 40° C., and in another embodiment, the temperature is greater than 45° C. Some enzymes may be found in nature or engineered to be active at higher temperatures, in which case, in one embodiment, the temperature is greater than 50° C., and in another embodiment, the temperature is greater than 60° C. In another embodiment, the maximum temperature is that in which the enzymes remain active for the duration of the reaction.

The pH can be kept constant or can be varied during the reaction. Enzymes typically exhibit maximum activity at a specific pH or pH range. Outside of this range, the rate of the reaction will decline. Too low (acidic) or too high (alkaline) pH can inactivate the enzymes, so range must be determined depending upon the particular enzymes. Furthermore, the overall rate of the reaction may be dependent upon more than the enzymatic activity, in which case the overall rate of the reaction may be optimized at a pH distinct from what is considered the maximum for the enzyme activity. For the reaction described herein, in one embodiment, the pH is less than 6.0, and in another embodiment, the pH is less than 5.5. In one embodiment, the pH is less than 5.0, and in another embodiment, the pH is less than 4.5. In one embodiment, the pH is less than 4.0, and in another embodiment, the pH is less than 3.5. In one embodiment, the pH is less than 3.0, and in another embodiment, the pH is less than 2.5. The pH may be controlled by various methods and include, although not limited by, a buffering salt such as sodium citrate. A pH stat may also be used to control the addition of acid such as, but not limited to hydrochloric acid, or base such as, but not limited to sodium hydroxide.

The reaction is allowed to proceed until much of the remaining non-trichome biomass is degraded, and the trichomes released from the biomass. Upon completion of the reaction, the aqueous suspension contains released trichomes, along with trichome free stems and other biomass that is not completely degraded. The trichomes are then removed and recovered from the suspension in such a way that the remaining non-trichome biomass is separated from the trichomes and the trichomes are separated from the liquid.

In another embodiment of the present invention, the trichomes are removed from the suspension, separated from the remaining non-trichome biomass and recovered. Methods to accomplish this are known in the art and are not limited by those described herein. For example, trichome fibers can be removed from suspension using equipment used in the paper industry such as Pressure Screens (Kadant Black Clawson LLC, Mason, Ohio, USA; Zhengzhou Leizhan Technology Paper Machinery Co., LTD, Dawei Town, Xinmi City, Henan Province, China), hydrocyclones (Kadant Black Clawson LLC, Mason, Ohio, USA; AKW Apparate+Verfahren GmbH, Hirschau, Germany) and Deep Air Flotation (FRC Systems International, Cumming, Georgia, USA; Evoqua Water Technologies LLC, Pittsburgh, PA, USA). Another option is to pass the suspension through a series of screens of decreasing pore size in which stems and undegraded biomass are retained on larger pore screens, whilst the trichomes pass through and are collected onto smaller pore screens. Other methods to remove stems are known such as the grape stem remover used in the wine industry.

EXAMPLES

Example 1: Demonstration that Pectinases with or without Cellulases Release Trichomes Leaves, stems and bracts from dried Lamb's Ear were cut into 3-5 mm pieces. The 150 mg of plant material was wetted by adding 0.01% w/v of Triton X-100 in 20 mL of 50 mM potassium phosphate buffer, pH 4.5 in 250 mL shake flasks. Pectinase enzymes were added in the relevant flasks for a total of 200 U (100 U each of pectinase from *Aspergillus niger* (Sigma Cat. #17389) and *Aspergillus aculeatus* (Sigma Cat. #P2611), or 200 U of the individual pectinase). Where noted, 100 U of *Trichoderma reseii* cellulase (Sigma Cat. #C2730) was added. The experiment was initiated by addition of enzyme. Enzymes were added to the samples, gently swirled to dissolve and distribute the enzymes, and incubated without shaking at 21° C. After incubation for 24 and 48 h, the flasks were vigorously shaken by hand for 1 min before drawing off liquid. Samples were observed for trichome release and the $OD_{600}$ was measured (Table 1). Both a mixture of pectinases, or each individual pectinase, effectively released the trichomes upon shaking, whereas only a small amount of trichomes were released upon incubating in only buffer. These trichomes often presented themselves as entangled globs. Cellulase in combination with pectinases yields a higher $OD_{600}$, but the liquid was more homogeneous than for only pectinase, and may represent degradation of the trichomes and of the biomass.

TABLE 1

| Sample | A. a Pectinase | A. n Pectinase | Cellulase | 24 h $OD_{600}$ | 48 h $OD_{600}$ |
|---|---|---|---|---|---|
| 1 | − | − | − | 0.082 | 0.165 |
| 2 | + | + | − | 0.767 | 1.14 |
| 3 | ++ | − | − | 0.725 | 1.22 |
| 4 | − | ++ | − | 0.550 | 1.25 |
| 5 | − | − | + | 0.256 | 0.520 |
| 6 | + | + | + | 1.22 | 1.82 |

Example 2: Effect of pH on the Enzymatic Processing of Lamb's Ear Trichomes

Leaves, stems and bracts from dried Lamb's Ear were cut into 3-5 mm pieces. The 150 mg of plant material was wetted by adding 0.01% w/v of Triton X-100 in 20 mL of buffer in 250 mL shake flasks. Buffers used were 50 mM potassium phosphate, pH 4.5; 50 mM sodium acetate pH4.9; 80 mM potassium phosphate pH 6.0; 25 mM sodium phosphate pH 7.0; 50 mM Tris HCl pH 8.0; and 50 mM sodium bicarbonate pH 9.0 or 10.0. Samples were incubated at 21° C. for 72 h, the flasks were vigorously shaken by hand for 1 min before drawing off liquid and the $OD_{600}$ measured to determine background release of trichomes without enzyme. At 72 h, 100 Units each of pectinase enzymes *Aspergillus niger* and *Aspergillus aculeatus* were added to the samples. The suspensions were gently swirled to dissolve and distribute the enzymes, and incubated without shaking at 21° C. for 24 h. The flasks were vigorously shaken by hand for 1 min before drawing off liquid, observing for trichome release and measuring the $OD_{600}$ (Table 2). Maximal activity was demonstrated at pH 4.5, and decreased for all higher pH conditions (FIG. 1).

TABLE 2

| Sample pH | $OD_{600}$ 72 h | $OD_{600}$ 96 h |
|---|---|---|
| 4.5 | 0.266 | 1.22 |
| 4.9 | 0.130 | 0.990 |
| 6.0 | 0.190 | 0.542 |
| 7.0 | 0.234 | 0.462 |
| 8.0 | 0.205 | 0.582 |
| 9.0 | 0.188 | 0.180 |
| 10.0 | 0.228 | 0.227 |

Figure 2:
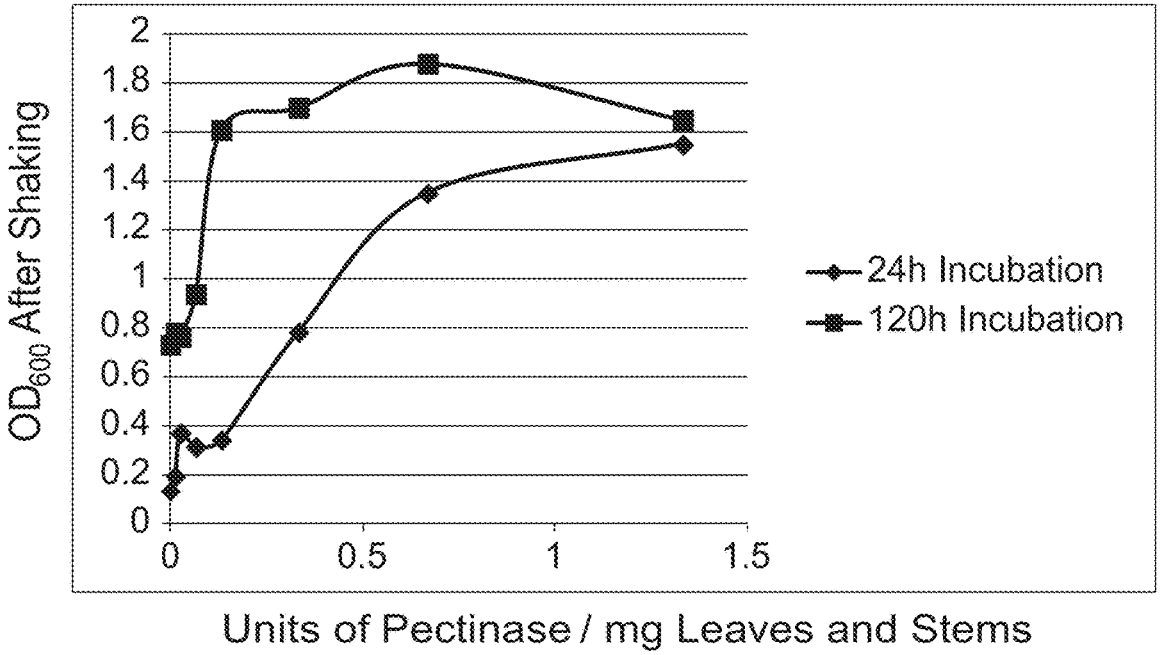
FIG. 2 is a chart demonstrating Pectinase catalyzed release of trichomes from cut, dry biomass vs. amount of enzyme added and time.

Example 3: Enzymatic Processing of Lamb's Ear Trichomes vs. Amount of Enzyme Leaves, stems and bracts from dried Lamb's Ear were cut into 3-5 mm pieces. 75 mg of plant material was wetted by adding 0.01% w/v of Triton X-100 in 10 mL of 50 mM potassium phosphate buffer, pH 4.5 in 125 mL shake flasks. *Aspergillus aculeatus* pectinase enzyme was added in the relevant flasks in amounts shown. The experiment was initiated by addition of enzyme. Enzyme was added to the samples, gently swirled to dissolve and distribute the enzyme, and incubated without shaking at 21° C. After incubation for 24 and 120 h, the flasks were vigorously shaken by hand for 1 min before drawing off liquid, observing the sample for trichome release and measuring the $OD_{600}$ (Table 3). Given enough time, as little as 5 units of pectinase (0.067 U/mg leaf/stems) removed some trichomes. As little as 10 Units (0.133 U/mg leaf/stems) gave complete removal (FIG. 2).

TABLE 3

| Sample | Units of Pectinase | Units/mg plant | 24 h $OD_{600}$ | 120 h $OD_{600}$ |
|---|---|---|---|---|
| 1 | 0 | 0 | 0.133 | 0.731 |
| 2 | 1 | 0.013 | 0.194 | 0.780 |
| 3 | 2 | 0.027 | 0.370 | 0.763 |
| 4 | 5 | 0.067 | 0.314 | 0.937 |
| 5 | 10 | 0.133 | 0.342 | 1.61 |
| 6 | 25 | 0.333 | 0.782 | 1.70 |
| 7 | 50 | 0.667 | 1.35 | 1.88 |
| 8 | 100 | 1.33 | 1.55 | 1.65 |

Example 4: Enzymatic Processing of Lamb's Ear Trichomes vs. Amount of Enzyme and Temperature Leaves, stems and bracts from dried Lamb's Ear were cut into 3-5 mm pieces. 75 mg of plant material was wetted by adding 0.01% w/v of Triton X-100 in 10 mL of 50 mM potassium phosphate buffer, pH 4.5 in 125 mL shake flasks. *Aspergillus aculeatus* pectinase was utilized in the amounts noted. The experiment was initiated by addition of enzyme.

Figure 3A:
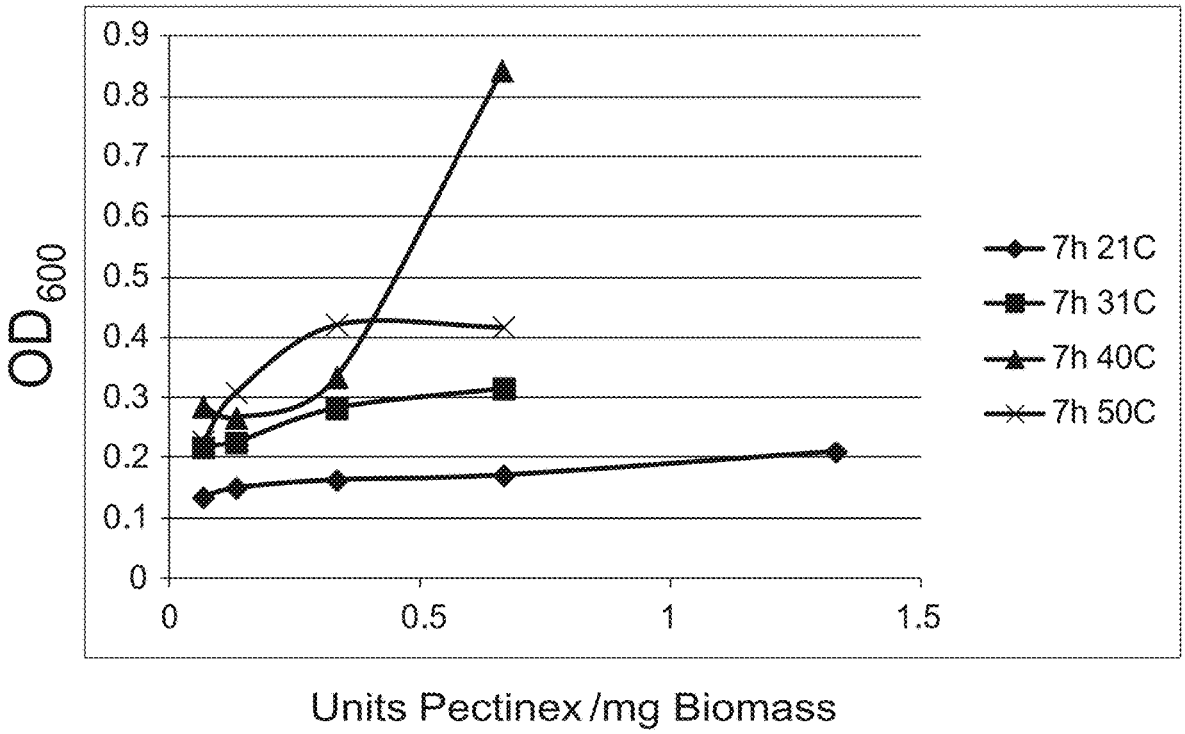
FIG. 3*a* is a chart demonstrating Pectinase catalyzed release of trichomes from cut, dry biomass at various temperatures of the reaction at 7 hours.
Figure 3B:
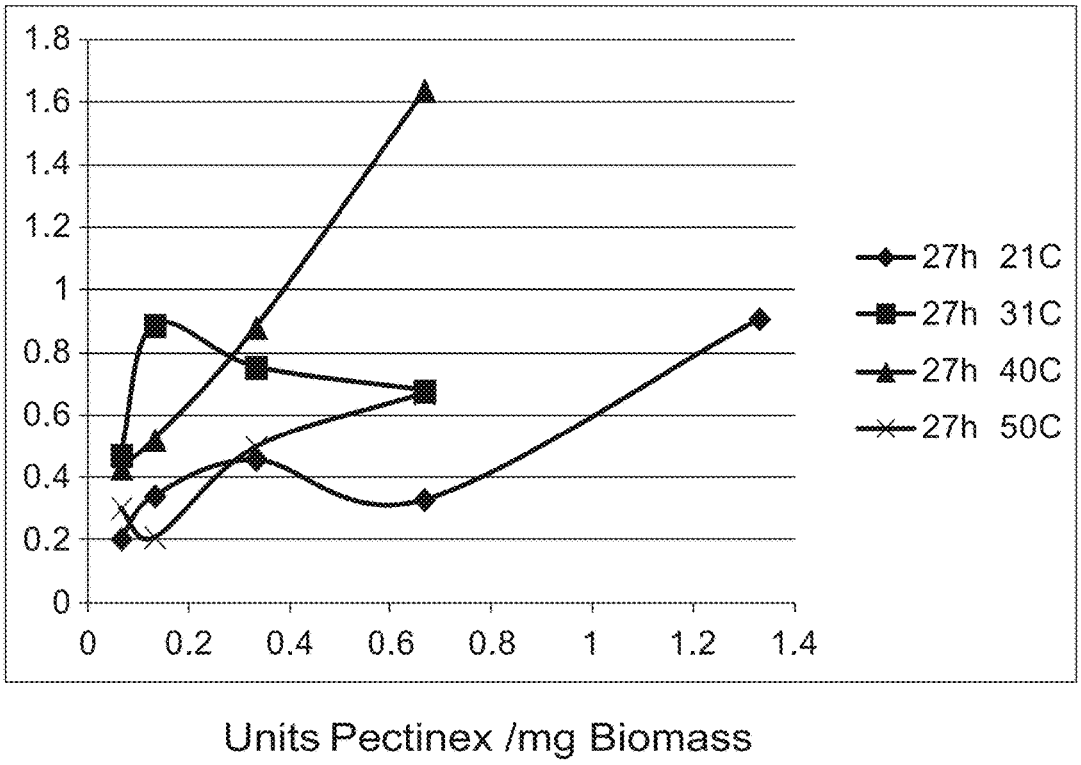
FIG. 3*b* is a chart demonstrating Pectinase catalyzed release of trichomes from cut, dry biomass vs. time and temperature of the reaction at 27 hours.
Figure 4A:
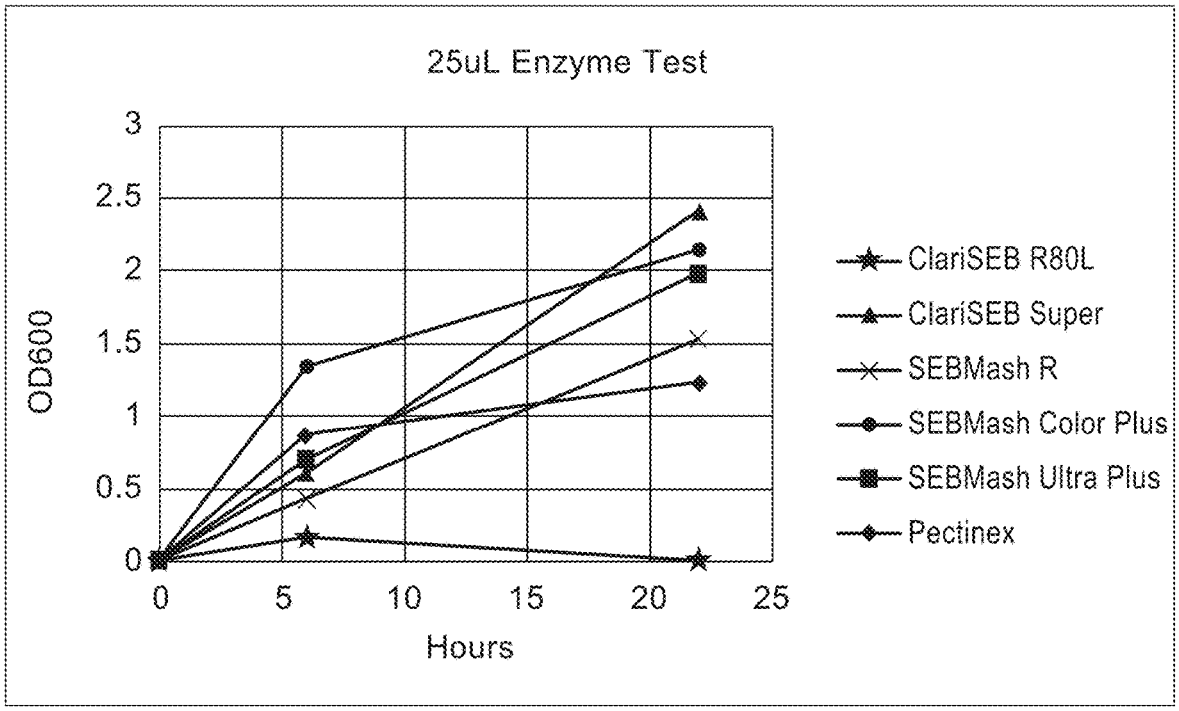
FIG. 4*a* is a chart demonstrating the potency of trichome release from dried biomass for a variety of Pectinase products at an enzyme level of 25 uL.
Figure 4B:
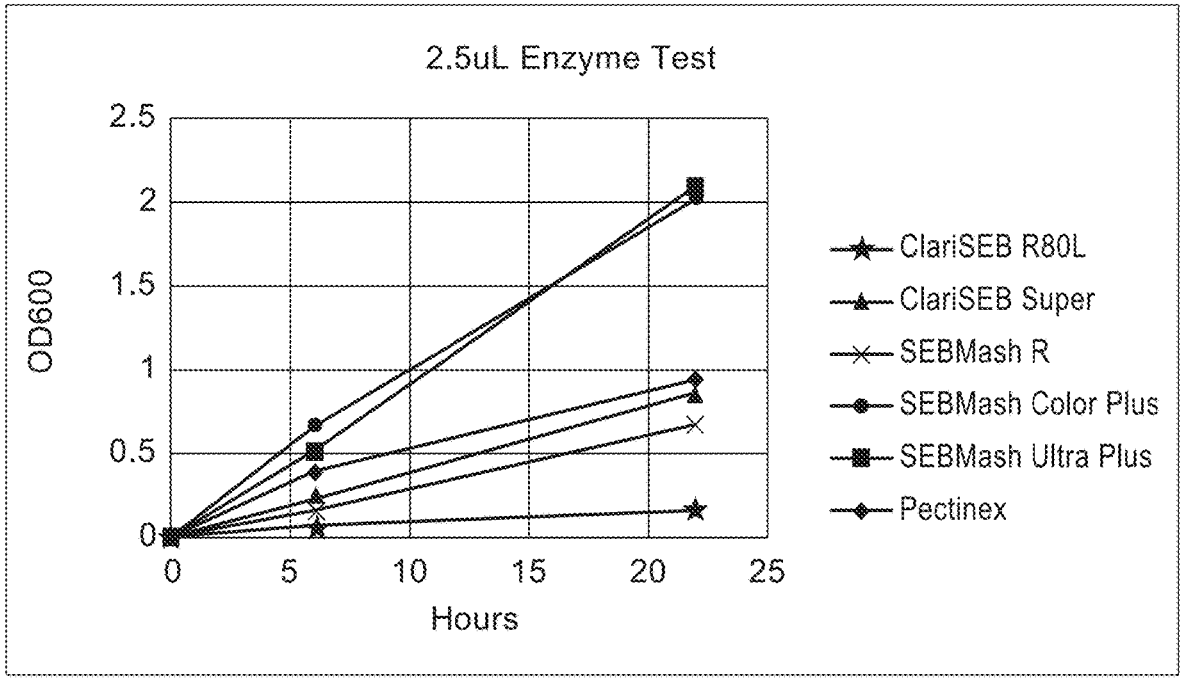
FIG. 4*b* is a chart demonstrating the potency of trichome release from dried biomass for a variety of Pectinase products at an enzyme level of 2.5 uL.
Figure 4C:
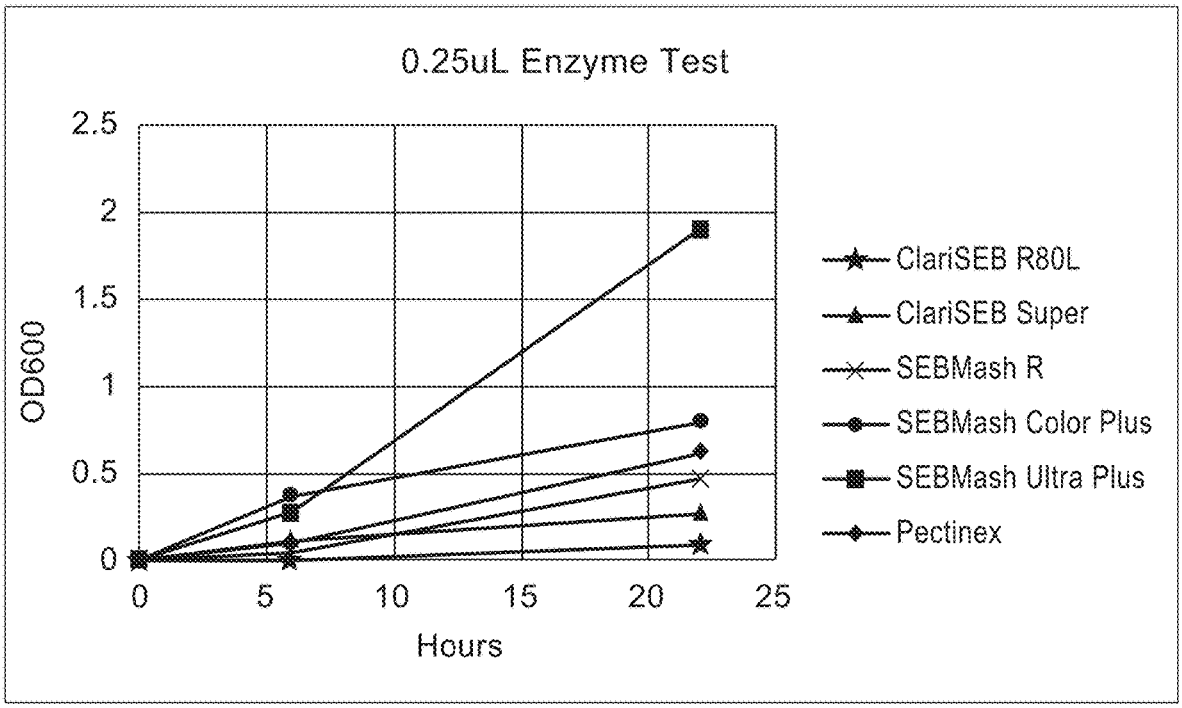
FIG. 4*c* is a chart demonstrating the potency of trichome release from dried biomass for a variety of Pectinase products at an enzyme level of 0.25 uL.
Figure 4D:
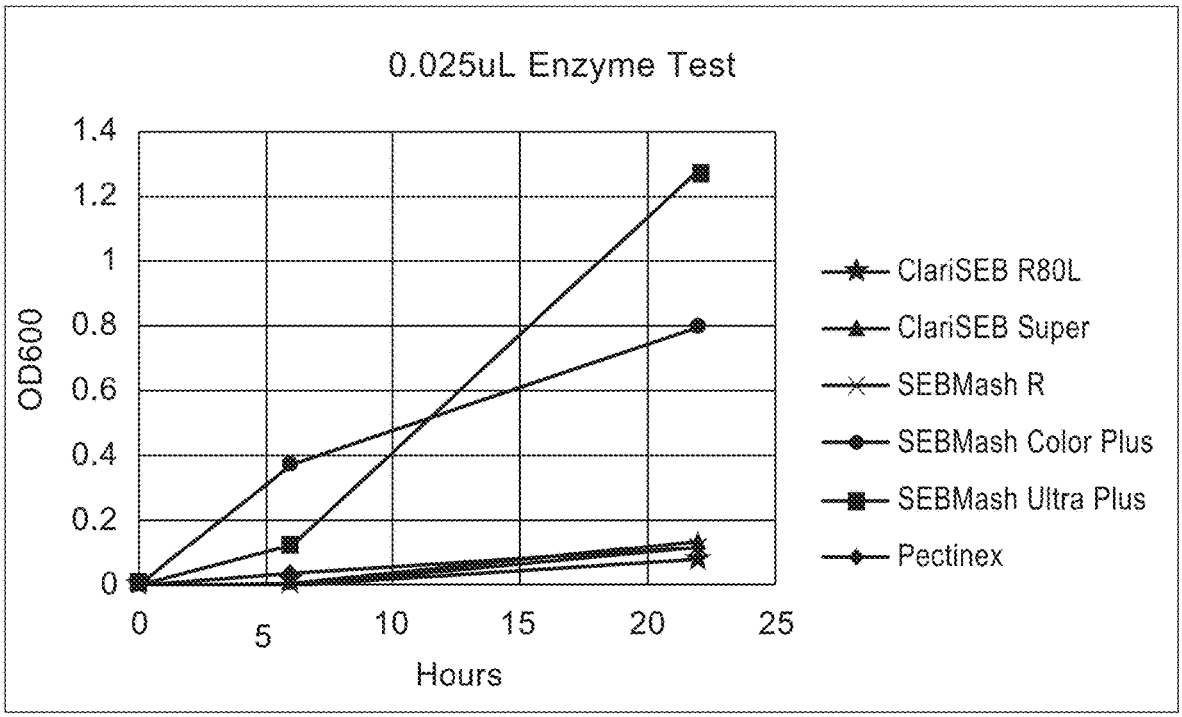
FIG. 4*d* is a chart demonstrating the potency of trichome release from dried biomass for a variety of Pectinase products at an enzyme level of 0.025 uL.
Figure 4E:
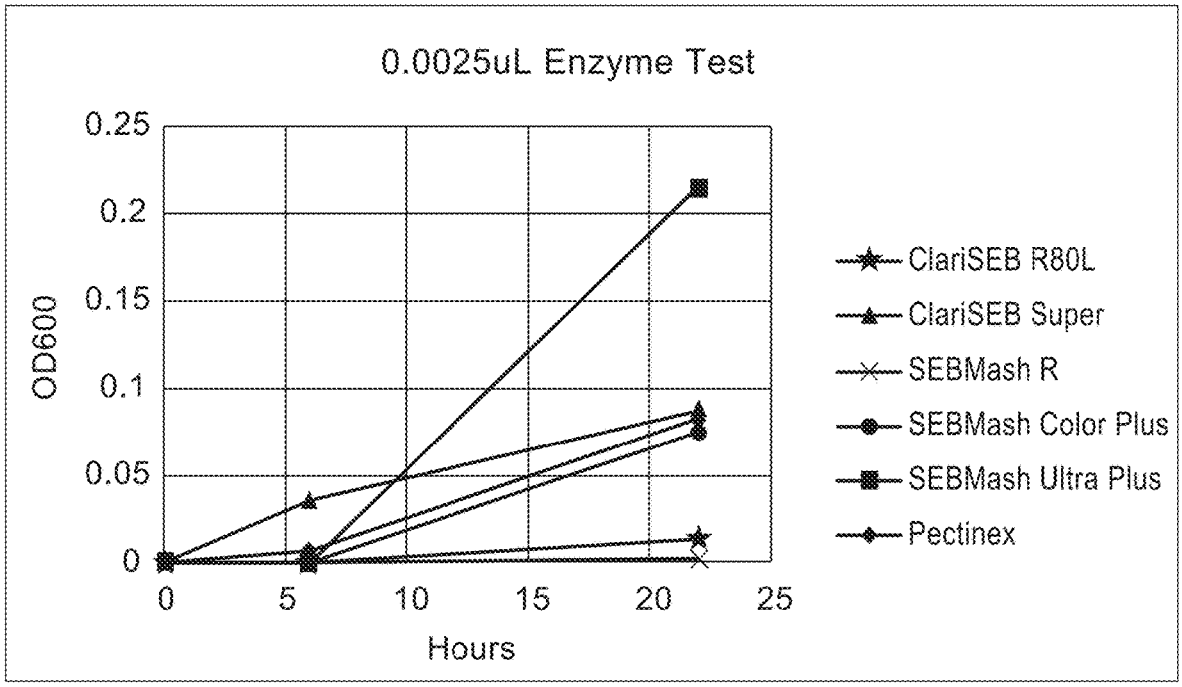
FIG. 4*e* is a chart demonstrating the potency of trichome release from dried biomass for a variety of Pectinase products at an enzyme level of 0.0025 uL.

Enzyme was added to the temperature equilibrated samples, gently swirled to dissolve and distribute the enzyme, and incubated without shaking at the different temperatures. Analysis of the extent of the reaction was determined at 7 h, then 27 h. The flasks were vigorously shaken by hand for 1 min before pouring off liquid, observing the sample for trichome release and measuring the $OD_{600}$ (Table 4). Increasing temperature to 40° C. sped up the reaction, however, 50° C. decreased the reaction, likely due to denaturation of the enzyme. As the temperature was raised to 40° C., less time was required to get similar extents of reaction (FIG. 3).

TABLE 4

| Sample | Units of Pectinase | Units/mg plant | ° C. | 7 h $OD_{600}$ | 27 h $OD_{600}$ |
|---|---|---|---|---|---|
| 1 | 5 | 0.067 | 21 | 0.135 | 0.205 |
| 2 | 10 | 0.133 | 21 | 0.15 | 0.342 |
| 3 | 25 | 0.333 | 21 | 0.163 | 0.458 |
| 4 | 50 | 0.667 | 21 | 0.171 | 0.330 |
| 5 | 100 | 1.33 | 21 | 0.210 | 0.908 |
| 6 | 5 | 0.067 | 31 | 0.218 | 0.470 |
| 7 | 10 | 0.133 | 31 | 0.226 | 0.887 |
| 8 | 25 | 0.333 | 31 | 0.283 | 0.754 |
| 9 | 50 | 0.667 | 31 | 0.316 | 0.678 |
| 10 | 5 | 0.067 | 40 | 0.286 | 0.430 |
| 11 | 10 | 0.133 | 40 | 0.268 | 0.522 |
| 12 | 25 | 0.333 | 40 | 0.335 | 0.881 |
| 13 | 50 | 0.667 | 40 | 0.843 | 1.64 |
| 14 | 5 | 0.067 | 50 | 0.229 | 0.303 |
| 15 | 10 | 0.133 | 50 | 0.310 | 0.210 |
| 16 | 25 | 0.333 | 50 | 0.422 | 0.497 |
| 17 | 50 | 0.667 | 50 | 0.418 | 0.670 |

TABLE 5

| Enzyme | Amount U/mg | Temperature ° C. | $OD_{600}$ 6 h | $OD_{600}$ 22 h |
|---|---|---|---|---|
| None | 0 | 31 | .145 | 0.142 |
| 62L | 1.3 | 31 | .558 | 1.88 |
| 62L | 0.65 | 31 | .746 | 1.17 |
| 62L | 0.13 | 31 | .392 | 0.874 |
| 62L | 0.065 | 31 | .221 | 1.11 |
| 62L | 1.3 | 50 | .728 | 1.17 |
| 62L | 0.65 | 50 | .602 | 1.37 |
| 62L | 0.13 | 50 | .551 | 0.709 |
| 62L | 0.065 | 50 | .346 | 0.571 |
| 831L | 1.3 | 31 | .592 | 1.09 |
| 831L | 0.65 | 31 | .332 | 1.28 |
| 831L | 0.13 | 31 | .317 | 0.78 |
| 831L | 0.065 | 31 | .211 | 0.695 |
| 831L | 1.3 | 50 | .632 | 1.55 |
| 831L | 0.65 | 50 | .396 | 1.01 |
| 831L | 0.13 | 50 | .331 | 0.95 |
| 831L | 0.065 | 50 | .201 | 0.534 |
| None | 0 | 50 | .071 | 0.134 |

Pectinase products from Enzyme Innovations were tested. These products contain combinations of different types of pectin active enzymes (Table 6).

TABLE 6

| Enzyme | Units | Endo-Polygalacturonase (endo-pectinase) | Pectin Lyase | Pectin Methylesterase | Hemicellulase |
|---|---|---|---|---|---|
| ClariSEB R80L | 80 uPL/g | + | + | + | − |
| ClariSEB Super | 200 uPL/g + 2000 uPOG/g | + | + | − | − |
| SEBMash R | 120,000 PBU/g | + | + | − | + |
| SEBMash Color Plus | 200,000 PBU/g | + | + | + | − |
| SEBMash Ultra Plus | 2,500 uPG/g | + | − | + | − |

Example 5: Multiple Pectinases Release Trichomes

Multiple commercially available Pectinase products were tested for their ability to release trichome trichomes from dried biomass. Biocatalysts, Inc. pectinase preparations 62 L and 831 L were tested. Leaves, stems and bracts from dried Lamb's Ear were cut into 3-5 mm pieces. 75 mg of plant material was wetted by adding 0.01% w/v of Triton X-100 in 10 mL of 50 mM potassium phosphate buffer, pH 4.5 in 125 mL shake flasks. Pectinases 62 L and 831 L were utilized in the amounts noted. The experiment was initiated by addition of enzyme. Enzyme was added to the temperature equilibrated samples, gently swirled to dissolve and distribute the enzyme, and incubated without shaking at the different temperatures. Analysis of the extent of the reaction was determined at 7 h, then 27 h. The flasks were vigorously shaken by hand for 1 min before pouring off liquid, observing the sample for trichome release and measuring the $OD_{600}$ (Table 5)

The pH of the buffer varied for each product and was 4.0 for SEBMash R, SEBMash Color Plus and SEBMash Ultra Plus. The buffer was pH 5.3 for ClariSEB™ R80 L and ClariSEB™ Super, and was pH 4.5 for the Petinex SPL. Incubation at 45° C. without shaking was initiated and samples were processed by shaking for 1 min and analyzed at approximately 6 h and 22 h (Table 7). As measured by $OD_{600}$, the SEBMash Color Plus product appears to be between 10-100× more potent than Pectinex, while the SEBMash Ultra Plus may be up to 1,000× more potent. A The SEBMash appears about equal to Pectinex, while the ClariSEB™ products are less potent (FIGS. 4*a*-4*e*).

TABLE 7

| Sample | Enzyme | Amount uL | $OD_{600}$ 6 h | $OD_{600}$ 22 h |
|---|---|---|---|---|
| 1 | None | 0 | 0.170 | 0.175 |
| 2 | ClariSEB R80L | 25 | 0.330 | 0.0516 |

TABLE 7-continued

| Sample | Enzyme | Amount uL | $OD_{600}$ 6 h | $OD_{600}$ 22 h |
|---|---|---|---|---|
| 3 | ClariSEB R80L | 2.5 | 0.236 | 0.336 |
| 4 | ClariSEB R80L | 0.25 | 0.147 | 0.259 |
| 5 | ClariSEB R80L | 0.025 | 0.142 | 0.255 |
| 6 | ClariSEB R80L | 0.0025 | 0.153 | 0.188 |
| 7 | ClariSEB Super | 25 | 0.772 | 2.59 |
| 8 | ClariSEB Super | 2.5 | 0.393 | 1.03 |
| 9 | ClariSEB Super | 0.25 | 0.278 | 0.438 |
| 10 | ClariSEB Super | 0.025 | 0.173 | 0.312 |
| 11 | ClariSEB Super | 0.0025 | 0.205 | 0.262 |
| 12 | SEBMash R | 25 | 0.607 | 1.71 |
| 13 | SEBMash R | 2.5 | 0.329 | 0.850 |
| 14 | SEBMash R | 0.25 | 0.210 | 0.642 |
| 15 | SEBMash R | 0.025 | 0.150 | 0.292 |
| 16 | SEBMash R | 0.0025 | 0.168 | 0.177 |
| 17 | SEBMash Color Plus | 25 | 1.51 | 2.32 |
| 18 | SEBMash Color Plus | 2.5 | 0.835 | 2.20 |
| 19 | SEBMash Color Plus | 0.25 | 0.539 | 0.970 |
| 20 | SEBMash Color Plus | 0.025 | 0.271 | 0.956 |
| 21 | SEBMash Color Plus | 0.0025 | 0.137 | 0.249 |
| 22 | SEBMash Ultra Plus | 25 | 0.868 | 2.16 |
| 23 | SEBMash Ultra Plus | 2.5 | 0.690 | 2.27 |
| 24 | SEBMash Ultra Plus | 0.25 | 0.445 | 2.08 |
| 25 | SEBMash Ultra Plus | 0.025 | 0.292 | 1.46 |
| 26 | SEBMash Ultra Plus | 0.0025 | 0.146 | 0.390 |
| 27 | Pectinex SPL | 25 | 1.05 | 1.41 |
| 28 | Pectinex SPL | 2.5 | 0.566 | 1.11 |
| 29 | Pectinex SPL | 0.25 | 0.271 | 0.786 |
| 30 | Pectinex SPL | 0.025 | 0.203 | 0.288 |
| 31 | Pectinex SPL | 0.0025 | 0.176 | 0.257 |

Pectawash 20 L, a pectin lyase was tested on 200 mL suspensions of 20 g of Lamb's Ear biomass homogenized in 25 mM Tris-HCl, pH 8.0 in shake flasks at 50° C. The results that are visually observed for the Pecta Wash 20 L enzyme is that at a volume of >16 uL per liter we can visually see the liberation of trichomes after 2 hours of incubation. Released fiber condensed into "tapioca" sized balls. However, after washing the sample, unlike the light brown/yellow tint of the trichomes from Pectinex preparations, the fiber/biomass mixture had a dark green color.

Other pectin active enzymes such as polymethyl galacturonase, (EC 3.2.1.-) and polygalacturonate lyase, (EC 4.2.2.9) may be used.

Figure 5:
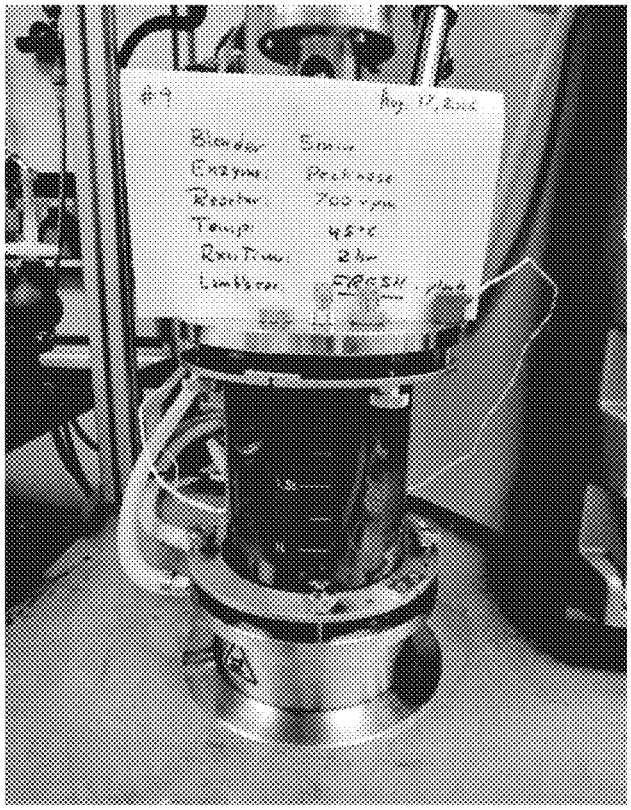
FIG. 5 is a photograph of a fermentor vessel used as a stirred tank reactor for the enzyme catalyzed release of trichomes from homogenized lambs ear.

Example 6: Enzymatic Release of Trichomes From Biomass in a Stirred Tank Reactor The enzymatic process detaches trichomes from fresh leaves. In one method, 100.22 g of biomass was first homogenized on high for 5 min in 25 mM sodium citrate, pH 4.5 using a Waring Commercial NuBlend Elite blender. The sample was mixed at 45° C. in a 2 L fermentation vessel (BioFlo), 1.715 mL of Pectinex was added and the reaction was run for 2 h (FIG. 5).

Example 7: Recovery of Trichomes from the Enzyme Processed Biomass

Figure 6:
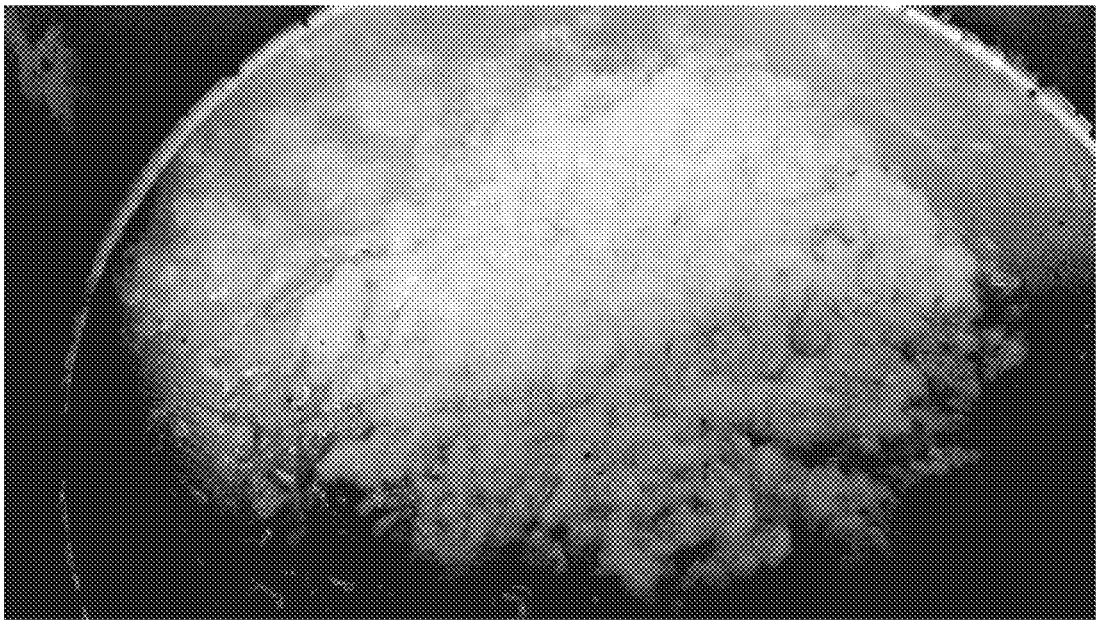
FIG. 6 is a photograph of trichomes recovered from the stirred tank reactor onto a 120 mesh screen.
Figure 7:
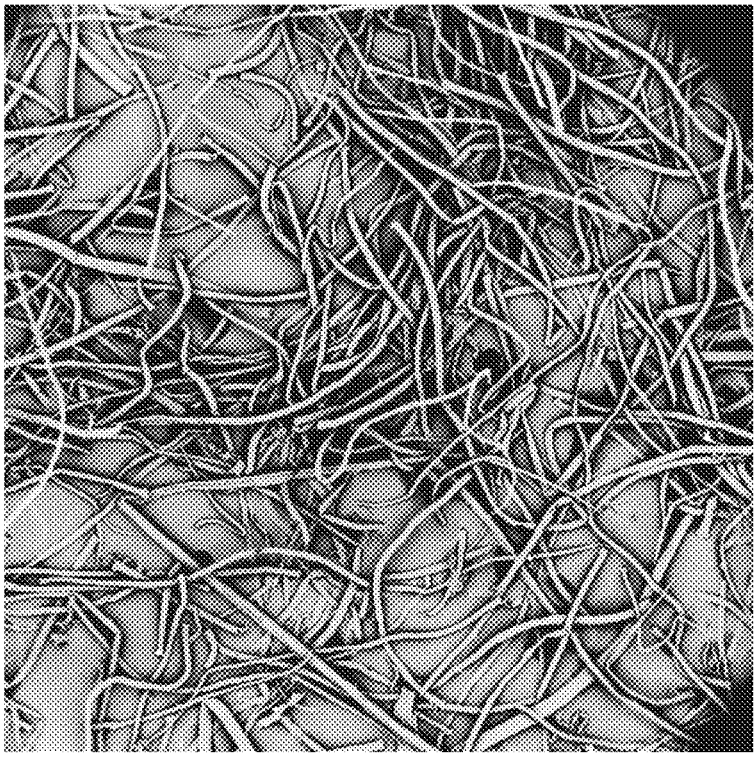
FIG. 7 is a scanning electron microscope image of enzymatically processed trichomes.

The trichomes were recovered and individualized by placing the mixture onto a 50 mesh screen, using a high pressure water spray to force the trichomes through the 50 mesh screen, and collecting the trichomes onto a 120 mesh screen (FIG. 6). Scanning electron microscopy was used to visualize the individualized trichomes (FIG. 7).

Example 8: Scaled up of the Enzymatic Process

Figure 8A:
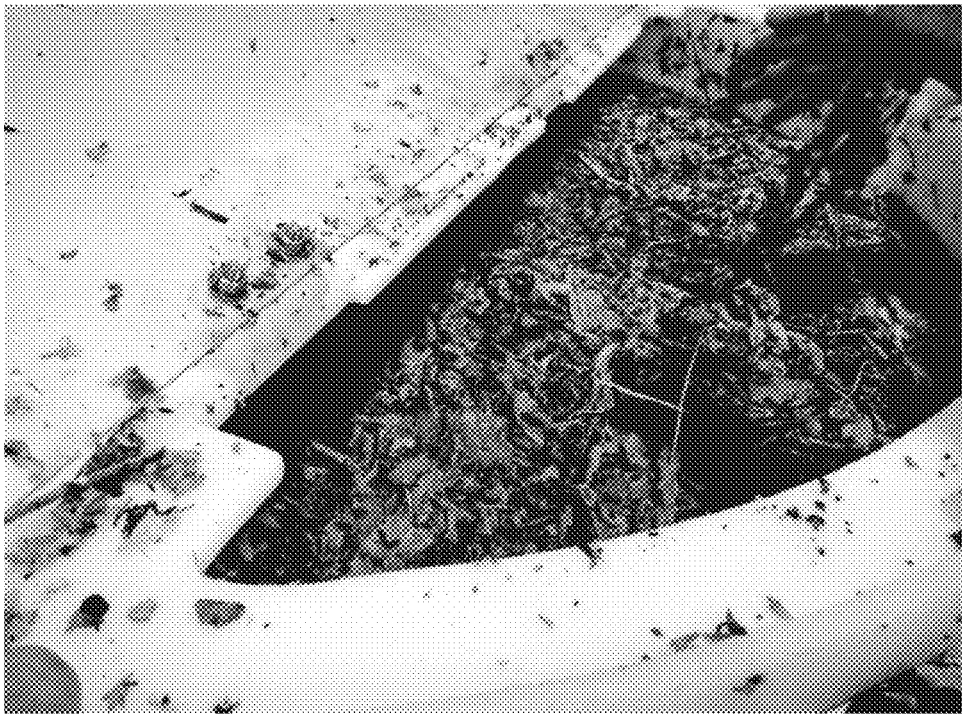
FIG. 8*a* is a photograph of Lamb's Ear biomass in the 300 gallon stirred tank reactor pre-Pectinase reaction.
Figure 8B:
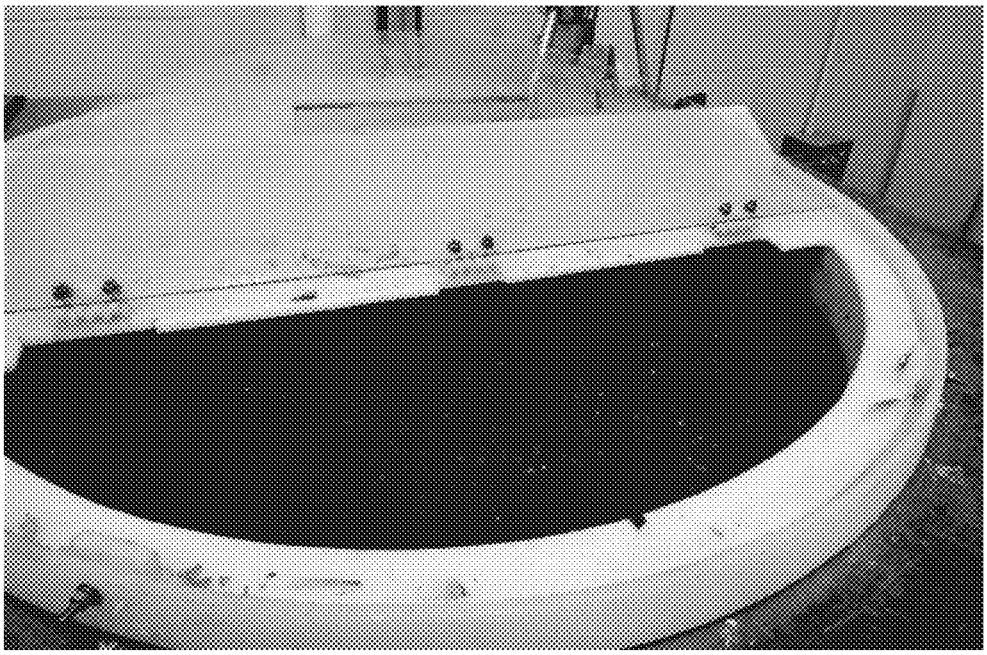
FIG. 8*b* is a photographs of Lamb's Ear biomass in the 300 gallon stirred tank reactor post-Pectinase reaction.

To demonstrate the scalability of the enzymatic process, 250 gallons of water heated to 45° C. was added to a 300 gal capacity tank. 4.8 kg of citric acid added, then 0.75 L of concentrated hydrochloric acid was added to adjust the pH to 2.0. 50 kg of lamb's ear was added to the tank with constant mixing, and hydrochloric acid was added to re-adjust the pH to 2.0 (FIG. 8A). 42.5 mL of Pectinase enzyme (*Aspergillus aculeatus* Sigma Cat. #P2611) was added to the tank and the suspension was stirred for 16 hours (FIG. 8B). The suspension was harvested and dewatered through screens, and trichomes were collected.

Example 9: Acid Release of Trichomes

Figure 9A:
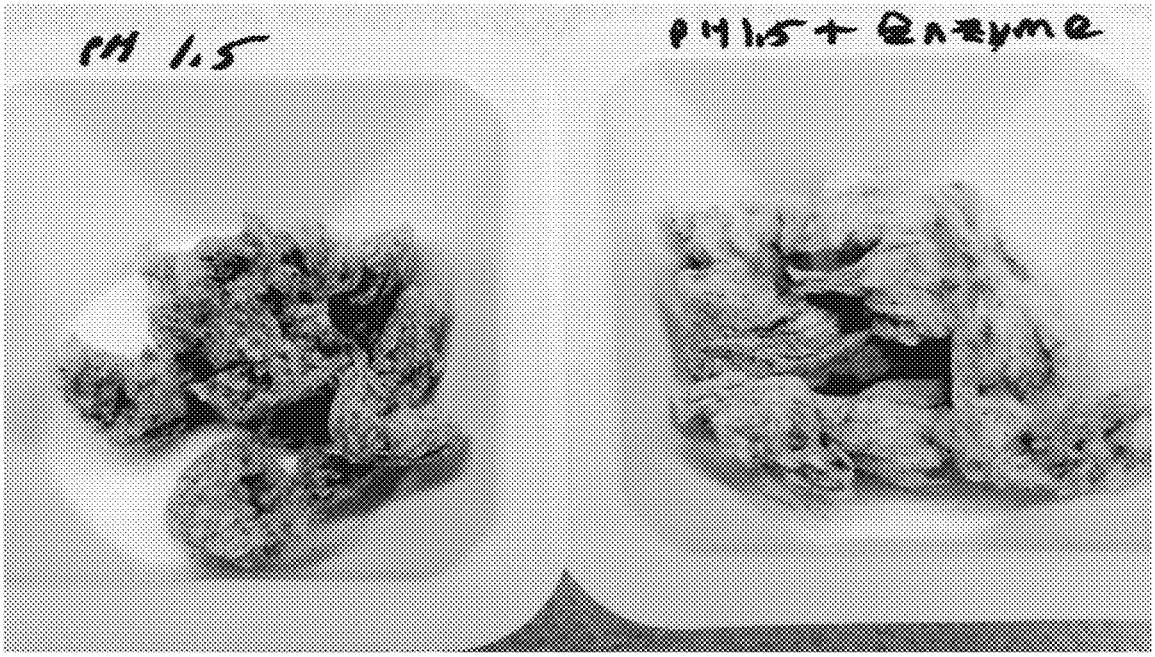
FIG. 9A is a photograph of trichomes recovered from fall harvest Lamb's Ear biomass using only pH 1.5 reaction medium, or the same with added Pectinase.
Figure 9B:
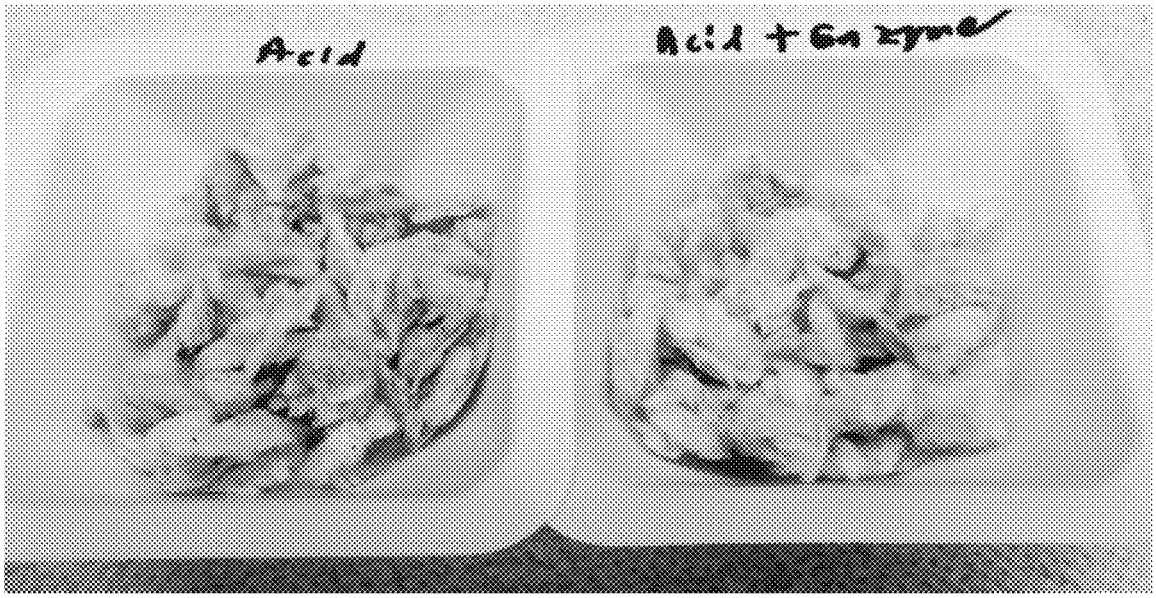
FIG. 9B is a photograph of trichomes recovered from summer harvest Lamb's Ear biomass using only pH 1.5 reaction medium, or the same with added Pectinase.
Figure 9C:
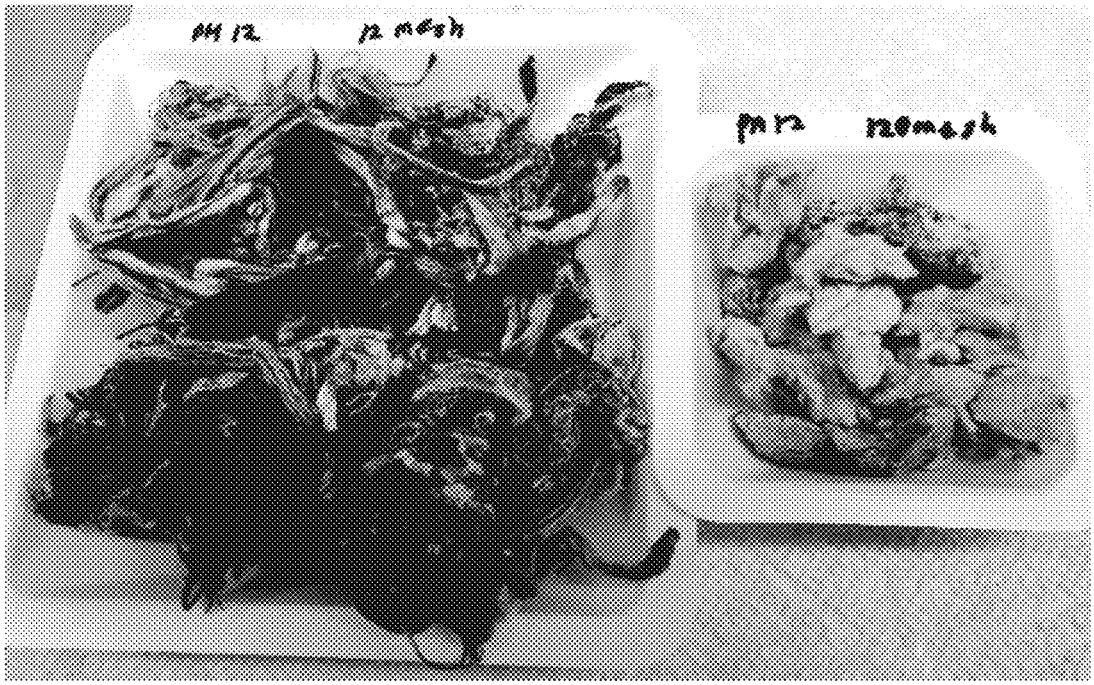
FIG. 9C is a photograph of 12 mesh retain and 120 mesh trichome retain from alkali pH 12 treated fall harvest Lamb's ear.

In a stirred vessel, 100 g of Lamb's Ear was added to 2 L of 25 mM Citric acid plus hydrochloric acid sufficient to adjust the pH to 1.5 and reacted at 45° C. for 16 h. In a second vessel, the same was reacted with the addition of Pectinase enzyme (SEBMash Ultra Plus). Trichomes released by only acid were a darker shade than those released by acid and enzyme (FIG. 9A), and were released in lower yield than with the enzyme. However, it was demonstrated that acidic conditions alone could release a large amount of Trichomes. The quality of the fiber released by acid depends on the quality of the Lamb's Ear biomass used. When leaves harvested during active growth in the summer were used, the color of the trichomes released by acid alone and acid plus enzyme were closer in color than for the autumn harvested biomass shown in FIG. 9A (FIG. 9B), although the yield of the enzyme treated biomass was higher. Raising the temperature of the acid reaction to 60° C. enabled release after only 8 h, and 80° C. enabled trichome release within 4 h. Less trichomes are released as the pH is increased. To test whether highly alkaline conditions also released trichomes, the suspension was brought to pH 12 with sodium hydroxide and reacted. Some trichomes were released, but much fewer than with acid, and it was noticed that a much larger portion of the plant was not disrupted and did not pass through a 12 mesh screen (FIG. 9C).

Example 10: Scaled up Acid Release

Figure 10A:
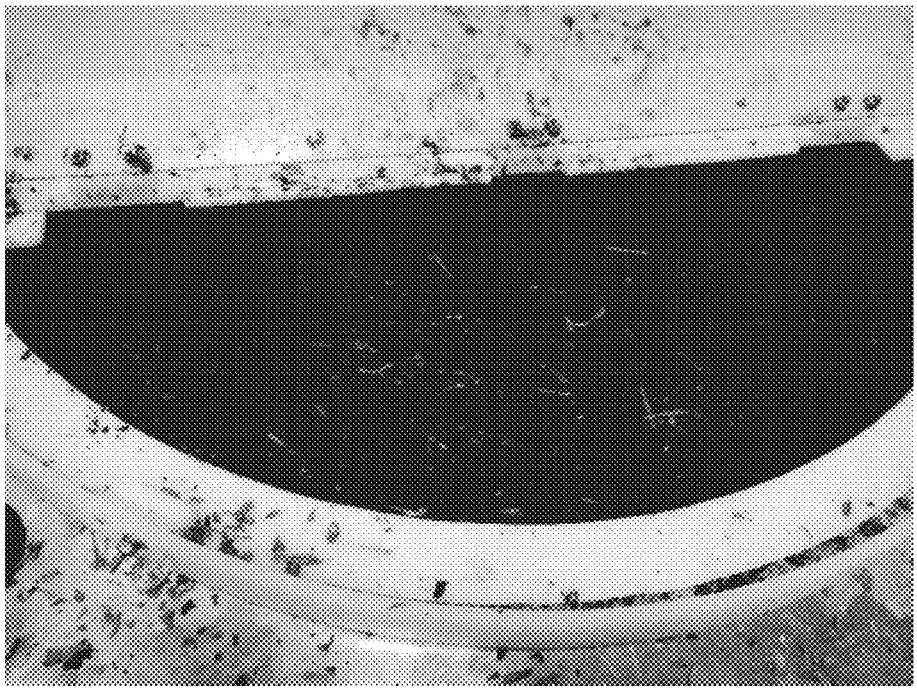
FIG. 10A is a photograph of post-300 gallon acid reaction of Lamb's Ear
Figure 10B:
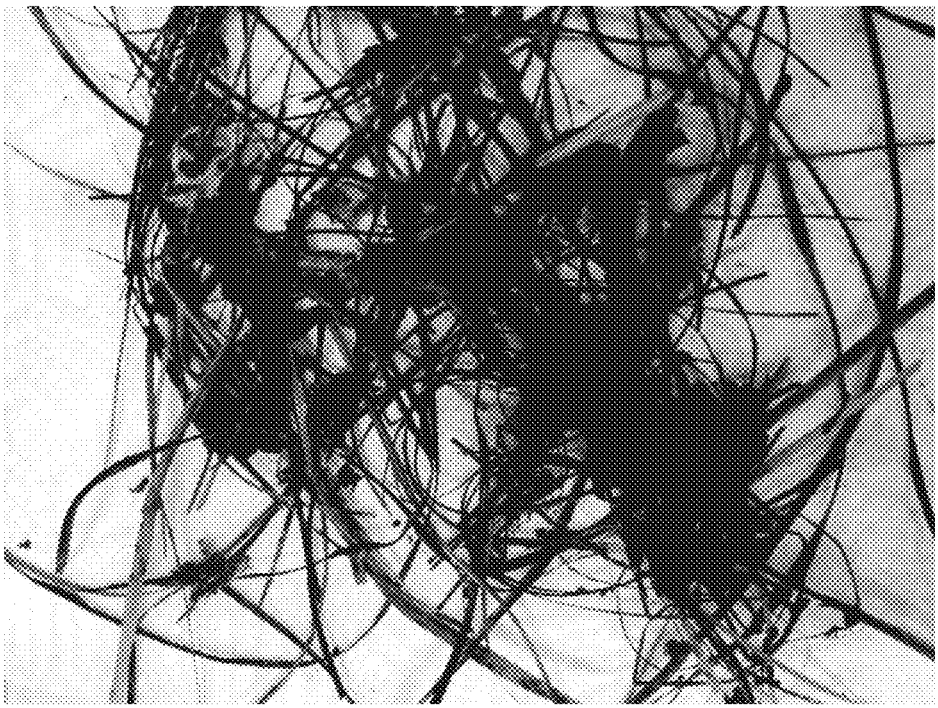
FIG. 10B is a photograph of undigested stems and grass impurities from the 300 gallon acid reaction

To demonstrate the scalability of the acid process, 250 gallons of water heated to 50.6° C. was added to a 300 gal capacity tank. 49.6 kg of lamb's ear was added to the tank with constant mixing, and 2.57 L of concentrated hydrochloric acid was added to adjust the pH to 1.5-2.0. After 6 h, concentrated hydrochloric acid was added to adjust the pH to 1.5-2.0 and the suspension was continued to be mixed for a total of 18 hours. The leaves were predominantly disrupted (FIG. 10A), although the suspension is darker as compared to Pectinase reaction (compare to FIG. 8B). Grass leaf impurities in the Lamb's Ear biomass preparation were not degraded under these conditions (FIG. 10B). This demonstrates that using more mild conditions than is normally used in, e.g., cellulosic biomass deconstruction, this reaction is more specific for release of trichomes from Lamb's Ear.

Example 11: Grasses and Lamb's Ear Leaves Reaction with Pectinase

Figure 11A:
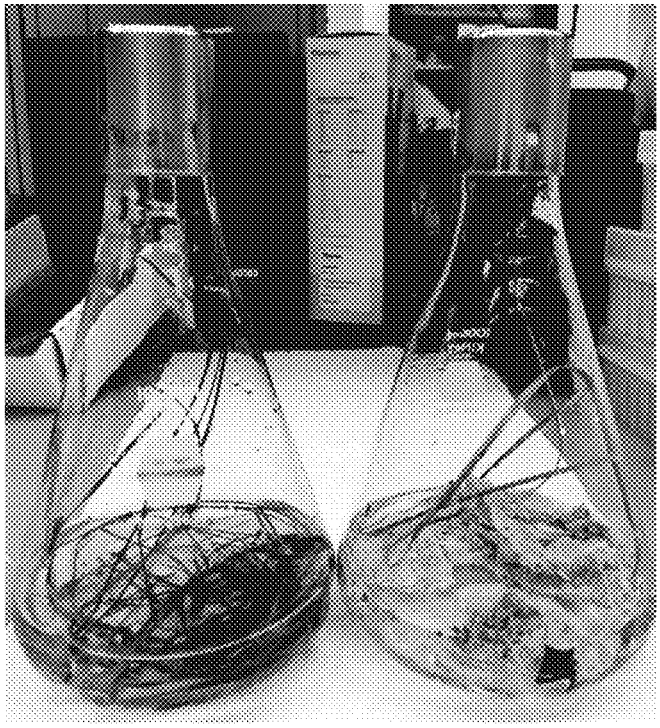
FIG. 11A is a photograph of undigested grass impurities from 300 gallon post-acid reaction and harvested Lamb's Ear leaves with some grass impurity
Figure 11B:
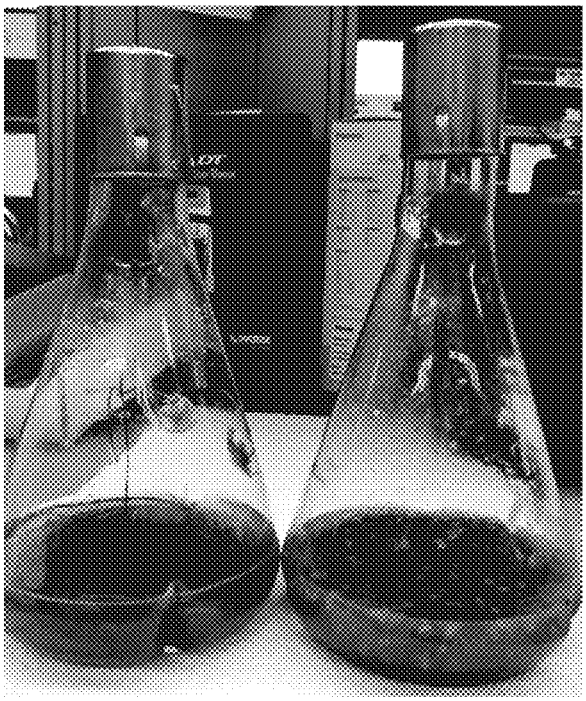
FIG. 11B is a photograph of undigested grass impurities from 300 gallon post-acid reaction and harvested Lamb's Ear leaves with some grass impurity reacted for 22 h at 40° C., pH 2.5 with 950 Units of Pectinase
Figure 11C:
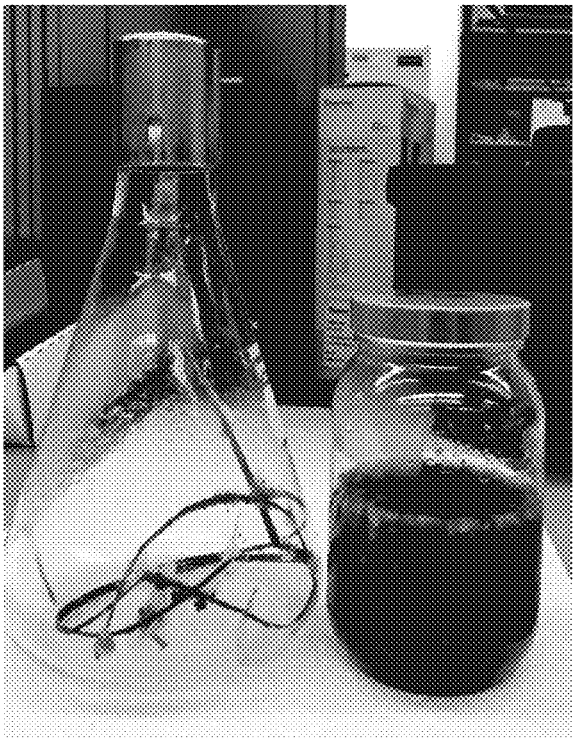
FIG. 11C is a photograph of pectinase reacted fresh Lamb's Ear separated into the undigested grass and the suspension of trichomes
Figure 11D:
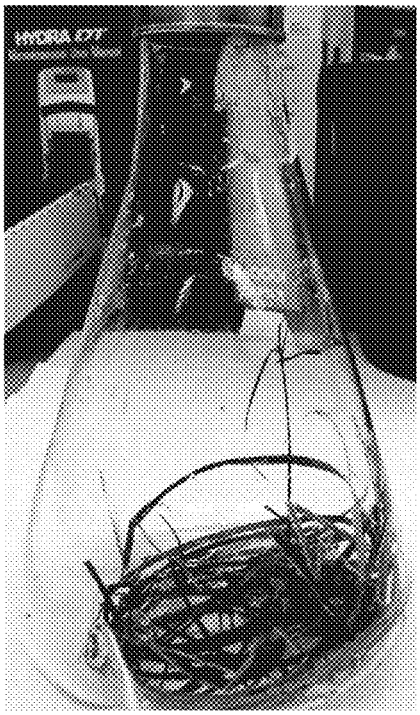
FIG. 11D is a photograph of pectinase reacted grass impurities from 300 gallon post-acid reaction

Five grams each of unreacted grasses from the 300 gallon acid reactions (Example 10) and Lamb's Ear leaves with some grass impurity were reacted with Pectinase in 25 mM sodium citrate, pH 2.5 at 40° C. with shaking at 150 rpm. FIGS. 11*a*-11*d* are photographs of these reactions at Time 0 (FIG. 11*a*), 22*h* (FIG. 11*b*), the leaves reaction split into unreacted grass and trichome suspension (FIG. 11*c*) and the unreacted grasses from the 300 gallon reaction (FIG. 11*d*). These observations are surprising and advantageous in that the conditions for both acid and enzymatic reactions do not appreciably affect the grass impurities, which should allow easier separation of the trichomes from grass impurities.

Example 12: Acid Plus Enzyme Release

To achieve the highest yield of fibers with lower levels of impurities at minimal time, a combination process was run in which the fibers were first exposed to acid at 80° C. for 4 h, then the temperature was lowered to 40° C. and the pH was raised to 2.5 with sodium hydroxide, and Pectinase was added. This was reacted for 8 h and the fibers recovered.

The foregoing description is given for clearness of understanding only, and no unnecessary limitations should be understood therefrom, as modifications within the scope of the invention may be apparent to those having ordinary skill in the art.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed:

1. A process for recovering individualized trichomes from plant biomass comprising:

obtaining a plant biomass comprising a plurality of trichomes;

preparing an aqueous mixture comprising the plant biomass, wherein the aqueous mixture does not comprise a chelator;

selecting one or more enzymes from the group consisting of Pectin Lyase (EC 4.2.2.10), Pectate Lyase (EC 4.2.2.2), and a Pectin Methyl Esterase (EC 3.1.1.11);

selecting a pH for the aqueous mixture based on the selected one or more enzymes, wherein the selected pH is in a range of from 1.5 to 4.5;

providing the aqueous mixture at the selected pH;

contacting the plant biomass in the aqueous mixture with the selected one or more enzymes to create a biomass-enzyme suspension;

allowing a reaction to proceed in the biomass-enzyme suspension until individualized trichomes are released from the plant biomass; and removing the individualized trichomes from the biomass-enzyme suspension.

2. The process of claim 1 wherein the plant biomass comprising trichomes is selected from the group consisting of leaves, stems, bracts and mixtures thereof.

3. The process of claim 1 wherein the one or more enzymes comprise from about 0.001 Kg to about 10 Kg by weight per metric ton of the biomass-enzyme suspension.

4. The process of claim 1 wherein the biomass-enzyme suspension has a pH of about 2.5.

5. The process claim 1 wherein the biomass-enzyme suspension has a temperature of greater than 30° C.

6. The process claim 1 wherein the plant biomass is contacted with the one or more enzymes for at least 1 minute.

7. The process of claim 1 further comprising the step of drying the individualized trichomes.

8. The process of claim 1 in where the plant biomass comprises *Stachys byzantina*.

9. The process according to claim 1 wherein the individualized trichomes have an average length greater than 0.5 mm as measured by Weighted Average Fiber Length Test.

10. The process according to claim 1 wherein less than 8% of the individualized trichomes are less than 0.2 mm as measured by Weighted Average Fiber Length Test.

11. The process according to claim 1 wherein less than 6% of the individualized trichomes are less than 0.2 mm as measured by Weighted Average Fiber Length Test.

12. The process according to claim 1 wherein less than 4% of the individualized trichomes are less than 0.2 mm as measured by Weighted Average Fiber Length Test.

* * * * *